US007232360B2

(12) United States Patent
Gadd

(10) Patent No.: US 7,232,360 B2
(45) Date of Patent: Jun. 19, 2007

(54) UNINTERRUPTED ABRASIVE FLUID SUPPLY

(75) Inventor: Michael William Gadd, Singapore (SG)

(73) Assignee: Jetsis International PTE Ltd., Singapore (SG)

( * ) Notice: Subject to any disclaimer, the term of this patent is extended or adjusted under 35 U.S.C. 154(b) by 0 days.

(21) Appl. No.: 11/150,044

(22) Filed: Jun. 10, 2005

(65) Prior Publication Data

US 2005/0287930 A1 Dec. 29, 2005

(51) Int. Cl.
*B24C 3/00* (2006.01)

(52) U.S. Cl. ..... 451/2; 451/3; 451/38; 451/60; 451/89; 451/100

(58) Field of Classification Search ..... 451/2, 451/36, 38, 39, 40, 60, 75, 89, 99, 100, 44, 451/3, 446; 417/102, 103, 900
See application file for complete search history.

(56) References Cited

U.S. PATENT DOCUMENTS 2,810,991 A * 10/1957 Mead et al. ..... 451/88
4,037,992 A * 7/1977 Uchida et al. ..... 417/102
4,381,897 A * 5/1983 Arbeletche et al. ..... 406/93
4,723,387 A * 2/1988 Krasnoff ..... 451/75
5,295,333 A * 3/1994 Puschner ..... 451/100
5,334,019 A * 8/1994 Goldsmith et al. ..... 433/88
5,839,951 A * 11/1998 Tomioka ..... 451/446
6,059,641 A * 5/2000 Okamoto ..... 451/99
6,200,203 B1 * 3/2001 Xu et al. ..... 451/99
6,848,979 B2 * 2/2005 Fennessy ..... 451/87
7,052,377 B2 * 5/2006 Tanoue et al. ..... 451/87

* cited by examiner

*Primary Examiner*—Eileen P. Morgan
(74) *Attorney, Agent, or Firm*—RatnerPrestia

(57) ABSTRACT

A substantially uninterrupted flow of a pressurised abrasive slurry is maintained by successively charging each of a plurality of vessels V1, V2 with an abrasive material while discharging an abrasive slurry from another of the vessels at a common outlet 2. The vessels connect to the common outlet via respective outlet valves OV1, OV2 which are closed to isolate vessels not discharging slurry. The outlet valves are not opened or closed unless there is substantially no pressure differential across the valve and substantially no flow through the valve. In a preferred arrangement, a high pressure pump 1 feeds a carrier fluid such as water to the vessels via respective inlet valves IV1, IV2. Before an outlet valve is opened or closed, any flow through the outlet valve is stopped and the pressure differential across the valve is equalised so that the outlet valve can be opened or closed without any abrasive flow through the valve.

56 Claims, 18 Drawing Sheets

UNINTERRUPTED ABRASIVE FLUID SUPPLY

FIELD OF INVENTION

The present invention relates to apparatus and methods for the control of a fluid flow, and more particularly to the provision of a substantially uninterrupted flow of a pressurised carrier fluid in which abrasive particles are suspended. In one application the uninterrupted flow is supplied to one or more nozzles, each producing an abrasive cutting jet. Abrasive particles are suspended in a carrier fluid, such as water, which is then applied at high pressure through the nozzle(s) to form the cutting jet(s).

BACKGROUND

The invention has application to the control of fluid flow and particularly the control of fluids containing abrasive material which can cause undesirable wear and erosion of control valve parts.

The use of abrasive materials in a fluid jet is well known, for example for machining operations such as cutting, drilling and surface finishing. In one known arrangement, a high pressure carrier fluid, for example water or air, is pumped into a vessel containing abrasive particles to force a mixture of the abrasive particles entrained in the carrier fluid as a slurry through a nozzle which forms a well-defined abrasive jet.

In a known arrangement a vessel is charged with an abrasive particulate material. A pressurised supply of carrier fluid is applied to the vessel where the carrier fluid and abrasive material mix to form an abrasive slurry which is discharged through the jet-forming nozzle. However, the duration of the supply of the abrasive slurry is limited by the capacity of the vessel and cannot continue without an interruption while the vessel is being refilled with abrasive material.

To maintain as near as possible a continuous abrasive flow from the jet nozzle, it is known to provide a pair of vessels in parallel or series so that one vessel can be de-pressurised and re-charged with abrasive while the other vessel, being pressurised with a carrier fluid, provides the abrasive supply to the nozzle.

European patent application No. 313,700 (Krasnoff) describes a water jet cutting system using an abrasive slurry. The inlets and outlets of a pair of vessels are connected to a pair of changeover valves. The valves are coupled together to alternately connect the vessels for recharging by induction of a slurry from a reservoir, then for pressurised discharge of the slurry at a nozzle.

International patent application No. WO 90/15694 (Saunders et al) describes a device for delivering abrasive liquid slurry to a cutting jet. There is a pair of pressure vessels connected in parallel between a supply of pressurised water and a nozzle. One vessel supplies an abrasive mixture under high pressure to the nozzle while the other vessel is replenished with abrasive from a common hopper.

A clean carrier liquid (water) is fed at a high pressure via an inlet valve into the top of the first vessel containing the abrasive mixture to force abrasive slurry from the vessel and via an outlet valve to the jet nozzle. The inlet valve is closed to stop delivery of the abrasive from that vessel. A flushing valve is opened to flush the outlet valve with a clean liquid flow allowing the outlet valve to be closed without abrasive particles causing undue wear of the moving parts. The flushing causes variations in the abrasive concentration of the abrasive mixture which are smoothed by a vessel downstream of the outlet valve.

U.S. Pat. No. 5,800,246 (Naoyoshi Tomioka) describes a blasting apparatus having a pair of vessels in parallel between a nozzle and a common hopper holding an abrasive material. Each vessel alternately recharges with abrasive from the hopper and then discharges the abrasive via the nozzle.

Wherever valves are used to control the flow of abrasive material, the valve is vulnerable to rapid wear and deterioration of the valve seal surfaces. In the absence of special techniques to avoid this deterioration, valves used to control abrasive flows can be expected to have a short operating lifespan. Many valves are unsuitable for use in the presence of a high-pressure abrasive flow.

SUMMARY OF INVENTION

An object of at least one embodiment of the invention is to provide a substantially uninterrupted flow of an abrasive fluid.

An object of at least one embodiment of the invention is to reduce the wear of valves used for the control of a substantially uninterrupted flow of an abrasive fluid.

An object of at least one embodiment of the invention to provide a substantially uninterrupted flow of abrasive fluid while reducing some of the problems associated with the prior art, or at least to provide the public with a useful choice.

In a first aspect the invention may be broadly said to be a method of maintaining a substantially uninterrupted flow of a pressurised abrasive slurry, the method including the steps of:

(a) discharging abrasive slurry from one vessel of a plurality of vessels while charging another of the plurality of vessels with an abrasive material, (b) successively repeating step (a) to recharge each vessel in turn with abrasive material while alternately discharging abrasive slurry from each vessel in turn, and (c) passing the abrasive slurry discharged from the vessels through respective flow-controlling outlet valves to a common outlet at which the substantially uninterrupted flow is maintained, wherein each of the outlet valves is not opened or closed unless there is substantially no pressure differential across the valve and substantially no flow through the valve.

Preferably the outlet valve of the vessel being recharged with abrasive material is closed to isolate that vessel from the common outlet while that vessel is being recharged but is subsequently open to allow that vessel to discharge abrasive slurry.

The vessels may be fed from a common source of pressurised carrier fluid via respective flow-controlling inlet valves, so that the carrier fluid is introduced to each vessel and combined with the abrasive material to form the abrasive slurry.

Preferably, after each vessel is recharged with abrasive material, the recharged vessel is pressurised and then, after switching with a previously-discharging vessel, is discharged, by the following sequence of steps;

(d) pressurising the recharged vessel by opening the inlet valve of the recharged vessel while maintaining the outlet valve of the recharged vessel closed, (e) closing the inlet valve of the recharged vessel, (f) opening the outlet valve of the recharged vessel, (g) switching the previously-discharging vessel with the recharged vessel by opening the inlet valve of the recharged vessel and closing the inlet valve of the previously-discharging vessel, and (h) closing the outlet valve of the previously-discharging vessel.

Preferably the previously-discharging vessel is depressurised, recharged with abrasive material, and re-pressurised in readiness for a later discharge of abrasive slurry from the previously-discharging vessel, by following step (h) with the following sequence of steps:

(i) opening a depressurising valve of the previously-discharging vessel, (j) recharging the previously-discharging vessel with abrasive material, (k) closing the depressurising valve of the previously-discharging vessel, (l) pressurising the previously-discharging vessel by opening the inlet valve of the previously-discharging vessel while maintaining the outlet valve of the previously-discharging vessel closed, (m) closing the inlet valve of the previously-discharging vessel, and (n) opening the outlet valve of the previously-discharging vessel.

Optionally, each vessel has an inlet conduit for feeding pressurised carrier fluid into the vessel and an outlet conduit for feeding abrasive slurry from the vessel to its outlet valve, and each vessel is fed from the common source of pressurised carrier fluid via a respective pair of flow-controlling inlet valves, a first valve of the pair being an abrasive flow control valve which connects the pressurised carrier fluid supply to the inlet conduit for pressurising the vessel and forcing abrasive material from the vessel via the outlet conduit, and the second valve of the pair being a carrier fluid control valve which connects the pressurised carrier fluid supply via an intermediate conduit to the outlet conduit where the carrier fluid mixes with the abrasive material to form the abrasive slurry.

The common outlet may be one or more nozzles, each for forming the uninterrupted flow of pressurised abrasive slurry into a defined jet.

In a preferred system, the number of vessels is two, abrasive slurry is discharged from a first of the two vessels while the second vessel is charged with the abrasive material, and abrasive slurry is discharged from the second vessel while the first vessel is charged with the abrasive material.

In a second aspect the invention may be broadly said to be an apparatus for maintaining a substantially uninterrupted flow of a pressurised abrasive slurry, the apparatus including a plurality of vessels, each vessel being connected via a respective outlet valve to a common outlet, each vessel being connectable to a source of pressurised carrier fluid, the apparatus being arranged so that each vessel in turn, having previously been recharged with abrasive material, can be pressurised from the source of the carrier fluid to discharge an abrasive slurry at the common outlet while another of the vessels is being depressurised and recharged with an abrasive material, wherein each of the outlet valves is not opened or closed unless there is substantially no pressure differential across the valve and substantially no flow through the valve.

Preferably each vessel is connectable to the source of pressurised carrier fluid via a respective inlet valve, each vessel has a respective depressurising valve, and the apparatus is arranged so that simultaneously (a) the inlet and outlet valves of one vessel are open, (b) the depressurising valve of the one vessel is closed, (c) the inlet and outlet valves of another of the vessels are closed, and (d) the depressurising valve of the other vessel is open, so that when the one vessel is charged with abrasive material, pressurised carrier fluid can flow into the one vessel to mix with the abrasive material and discharge via the respective outlet valve at the common outlet as an abrasive slurry while the other vessel is being depressurised and recharged with abrasive material.

Preferably the apparatus is arranged to recharge a first of the vessels with abrasive material while a second vessel is discharging previously-charged abrasive material in the form of a slurry, after which:

(e) the first vessel is pressurised by opening and then closing the inlet valve of the first vessel, (f) the outlet valve of the first vessel is opened, (g) the inlet valve of the first vessel is opened and the inlet valve of the second vessel is closed, and (h) the outlet valve of the second vessel is closed.

Preferably the apparatus is arranged so that the second vessel is depressurised, recharged with abrasive material, and re-pressurised in readiness for a later discharge of abrasive slurry from the second vessel, by following step (h) with the following sequence of steps:

(i) opening a depressurising valve of the second vessel, (j) recharging the second vessel with abrasive material, (k) closing the depressurising valve of the second vessel, (l) pressurising the second vessel by opening the inlet valve of the second vessel while maintaining the outlet valve of the second vessel closed, (m) closing the inlet valve of the second vessel, and (n) opening the outlet valve of the second vessel.

Preferably each vessel has an inlet conduit for feeding pressurised carrier fluid into the vessel and an outlet conduit for feeding abrasive slurry from the vessel to its outlet valve, and each vessel is fed from the common source of pressurised carrier fluid via a respective pair of flow-controlling inlet valves, a first valve of the pair being an abrasive flow control valve which connects the pressurised carrier fluid supply to the inlet conduit for pressurising the vessel and forcing abrasive material from the vessel via the outlet conduit, and the second valve of the pair being a carrier fluid control valve which connects the pressurised carrier fluid supply via an intermediate conduit to the outlet conduit where the carrier fluid mixes with the abrasive material to form the abrasive slurry.

In a preferred apparatus the number of vessels is two, abrasive slurry is discharged from a first of the two vessels while the second vessel is charged with the abrasive material, and abrasive slurry is discharged from the second vessel while the first vessel is charged with the abrasive material.

In general terms at least one embodiment of the invention relates to a substantially uninterrupted flow of a pressurised abrasive slurry which is maintained by successively charging each of a plurality of vessels with an abrasive material while discharging an abrasive slurry from another of the vessels at a common outlet. The vessels connect to the common outlet via respective outlet valves which are closed to isolate vessels not discharging slurry. The outlet valves are not opened or closed unless there is substantially no pressure differential across the valve and substantially no flow through the valve. In a preferred arrangement, a high pressure pump feeds a carrier fluid such as water to the vessels via respective inlet valves. Before an outlet valve is opened or closed, any flow through the outlet valve is stopped and the pressure differential across the valve is equalised so that the outlet valve can be opened or closed without any abrasive flow through the valve.

The invention may further be said to consist in any alternative combination of parts or features mentioned herein or shown in the accompanying drawings. Known equivalents of these parts or features which are not expressly set out are nevertheless deemed to be included.

BRIEF DESCRIPTION OF THE DRAWINGS

Preferred embodiments and methods of the invention will be further described, with reference to the accompanying figures, by way of example only and without intending to be limiting, wherein.

DETAILED DESCRIPTION OF PREFERRED EMBODIMENTS

Referring to the figures it will be appreciated that the invention may be implemented in various forms and modes. The following description of preferred embodiments of the invention is given by way of example only.

References in this description and in the accompanying claims to pressurised elements in which there is no flow or in which the flow is blocked, and the like, are to be understood as referring principally to a steady-state condition applying after initial pressurisation of a conduit, vessel, valve, or other element in the system. Such references to blocked flow or no flow, and the like, are to be understood as not excluding situations in which a relatively brief initial flow may occur upon pressurisation of an element before the steady-state no flow condition prevails. In practice of the invention any such initial flows are usually negligible or relatively minor, particularly when the carrier fluid is a liquid.

Similarly, references in this description and in the accompanying claims to a substantially uninterrupted flow are to be understood as referring to a flow which is as much as possible substantially continuous and has no interruptions or at least has only minor or negligible interruptions, and are to be understood as including, but are not to be limited to, an absolutely uninterrupted flow.

Figure 1:
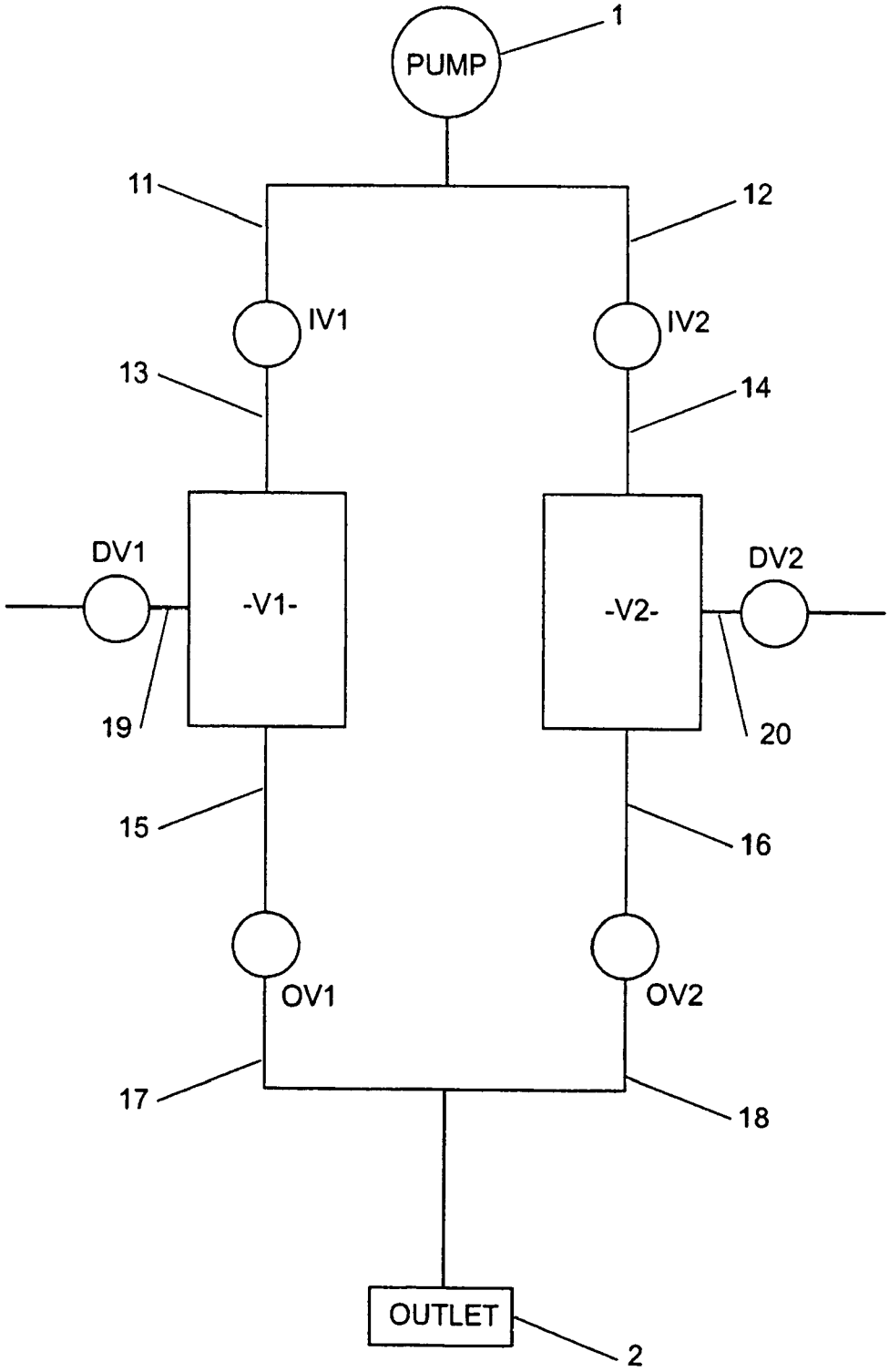
FIG. 1 shows schematically a first flow control system for providing an uninterrupted flow of abrasive fluid.

FIG. 1 shows a fluid flow control arrangement in which a pump 1 provides a high pressure supply of a carrier fluid, such as water, via a first conduit 11 to a first inlet valve IV1, and via a second conduit 12 to a second inlet valve IV2. The two inlet valves respectively feed a first vessel V1 and second vessel V2 via third conduit 13 and fourth conduit 14. The two vessels are respectively connected via fifth conduit 15 and sixth conduit 16 to first outlet valve OV1 and second outlet valve OV2. The outlet valves are respectively connected via seventh conduit 17 and eighth conduit 18 to a common outlet 2. Each vessel V1, V2 is also respectively connected via a ninth conduit 19 and a tenth conduit 20 to a first depressurising valve DV1 and a second depressurising valve DV2. These depressurising valves are opened when pressure in the respective vessel is to be lowered in readiness for recharging the vessel, e.g. from a hopper or other source at a lower, and typically atmospheric, pressure.

In FIGS. 1A to 1H various elements (i.e. the conduits, valves and vessels) are shown with continuous bold lines to represent the flow of pressurised fluid through the respective elements. Similarly, broken bold lines represent other elements in which there is pressurised fluid without fluid flow. Elements not pressurised are shown by continuous thin lines. Furthermore, the valves that change status, i.e. are opened or closed, at each stage are labelled in bold in the corresponding figure.

Figure 1A:
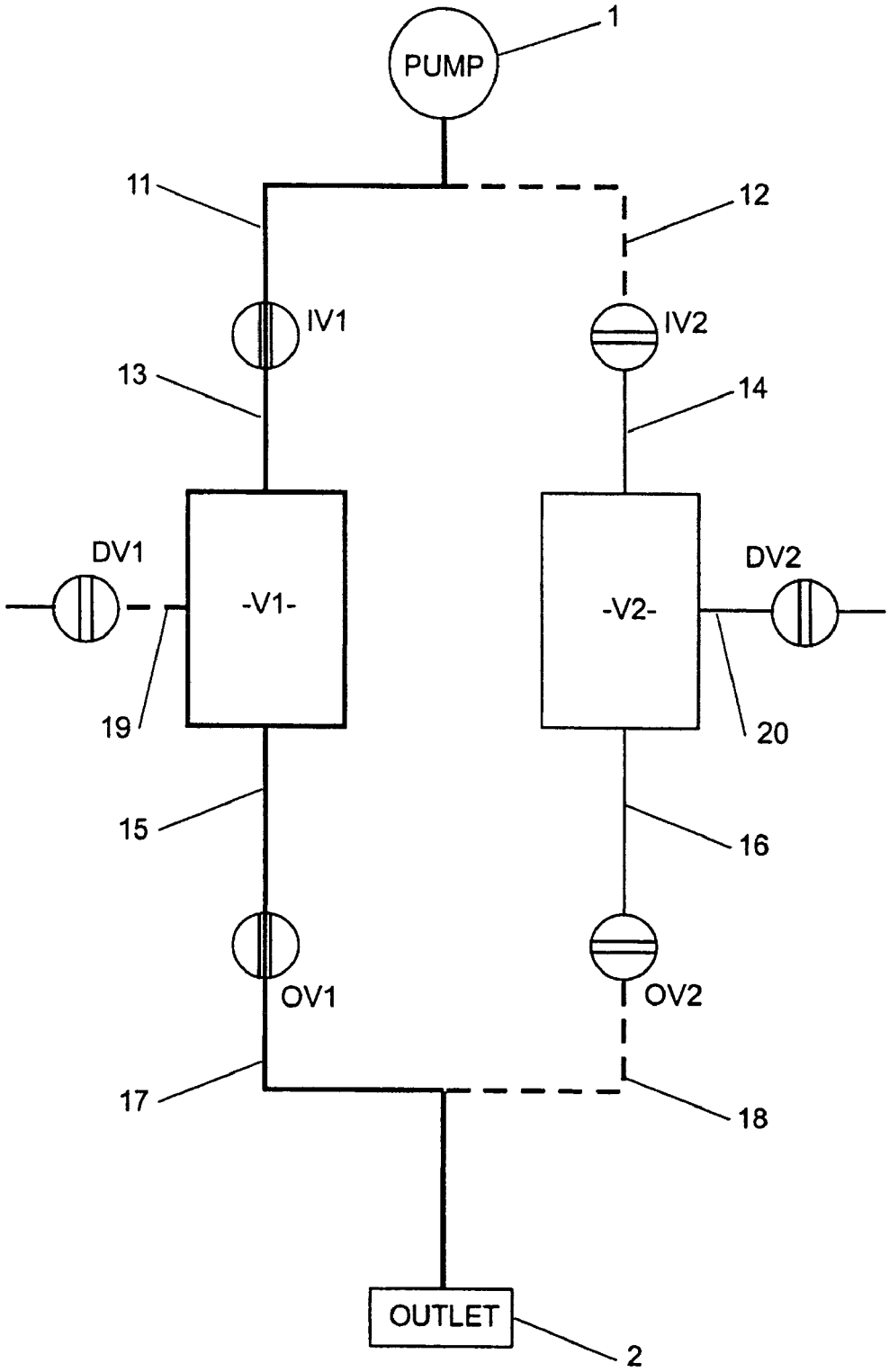
FIGS. 1A to 1H show schematically the flow control system of FIG. 1 at various stages of control.

In FIG. 1A, the first vessel V1 has been previously charged with an abrasive material, such as a particulate, (not shown). This first vessel V1 is pressurised with water from the high pressure pump 1 via the first conduit 11, the first inlet valve IV1, which is open, and the third conduit 13. The ninth conduit 19 of the first vessel is pressurised with high pressure water but flow through this ninth conduit is blocked by the first depressurising valve DV1, which is closed.

The first outlet valve OV1 is open allowing pressurised water to flow from the pump 1, through the first conduit 11, the first inlet valve IV1, the third conduit 13, and into the first vessel V1 where it mixes with the abrasive material to form a slurry (not shown). The slurry discharges from the first vessel V1 via the fifth conduit 15, the first outlet valve OV1 (which is open), the seventh conduit 17 and the common outlet 2.

This pressurised flow is shown by continuous bold lines in FIG. 1A and is maintained through the stages of operation shown in FIGS. 1A through 1D as explained further below.

The second conduit 12 leading to the second vessel V2 is pressurised with carrier fluid by the pump 1, but flow through this second conduit 12 is blocked by the second inlet valve IV2, which is closed. Accordingly, this second conduit 12 is shown in FIG. 1A by a broken bold line.

The eighth conduit 18 (in the output path of the second vessel V2) is pressurised with slurry from the seventh conduit 17. However, fluid flow through the eighth conduit 18 is blocked by the second outlet valve OV2, which is closed. Accordingly, this eighth conduit 18 is shown in FIG. 1A by a broken bold line.

While abrasive slurry from the first vessel V1 is discharging at the outlet 2, the second vessel V2 is isolated from pressurised fluids by the second inlet valve IV2 and the second outlet valve OV2, both of which are closed. The isolated second vessel V2 is initially depressurised by opening the second depressurising valve DV2. After the second vessel is depressurised, it is recharged with abrasive material (not shown). The second depressurising valve DV2 is then closed, as shown in FIG. 1A.

Figure 1B:
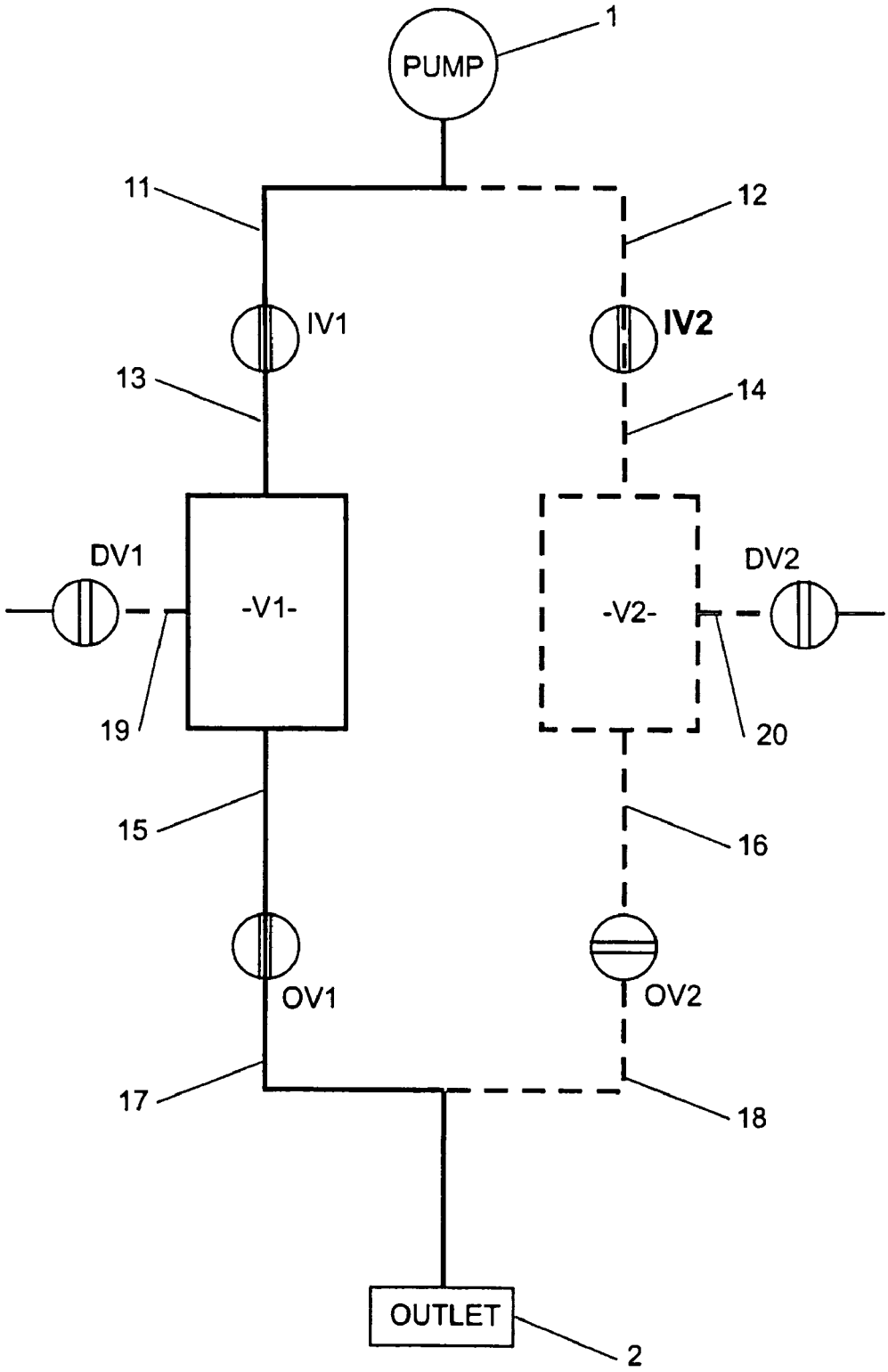

FIG. 1B shows a vessel re-pressurisation stage. In this stage the second vessel V2, having been recharged with abrasive material, is repressurised by opening the second inlet valve IV2 (labelled in bold in FIG. 1B). This operation connects pressurised carrier fluid from the pump 1, via the second conduit 12 and the second inlet valve IV2, to the fourth conduit 14, the second vessel V2, the sixth conduit 16 and the tenth conduit 20. However, fluid flow through these elements is blocked by the second outlet valve OV2 and the second depressurising valve DV2, both of which are closed. It is to be noted that there is no substantial pressure differential across the second outlet valve OV2 and no flow through it. The pressurised flow from pump 1 to outlet 2, via the first vessel V1 and its associated elements, is maintained, as shown by the continuous bold lines in FIG. 1B.

Figure 1C:
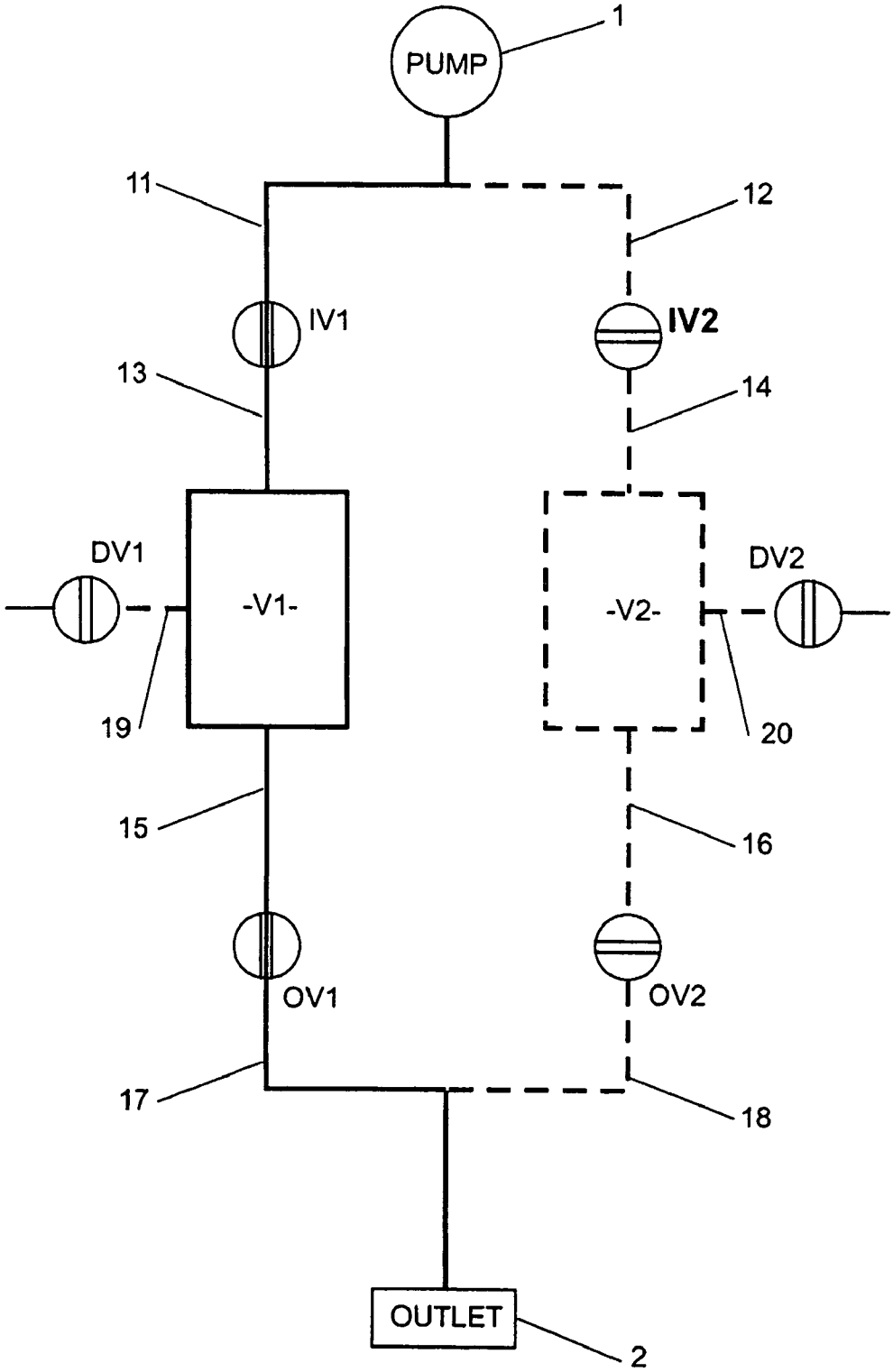

FIG. 1C shows a vessel isolation stage. After re-pressurisation of the second vessel V2, the second inlet valve IV2, labelled in bold in FIG. 1C, is closed. The second vessel V2 is now isolated but pressurised to substantially the same pressure as that of the pressurised flow through the first vessel V1. There is substantially no pressure differential across the second outlet valve OV2. The pressurised flow from pump 1 to outlet 2, via the first vessel V1 and its associated elements, is maintained, as shown by the continuous bold lines in FIG. 1C.

Figure 1D:
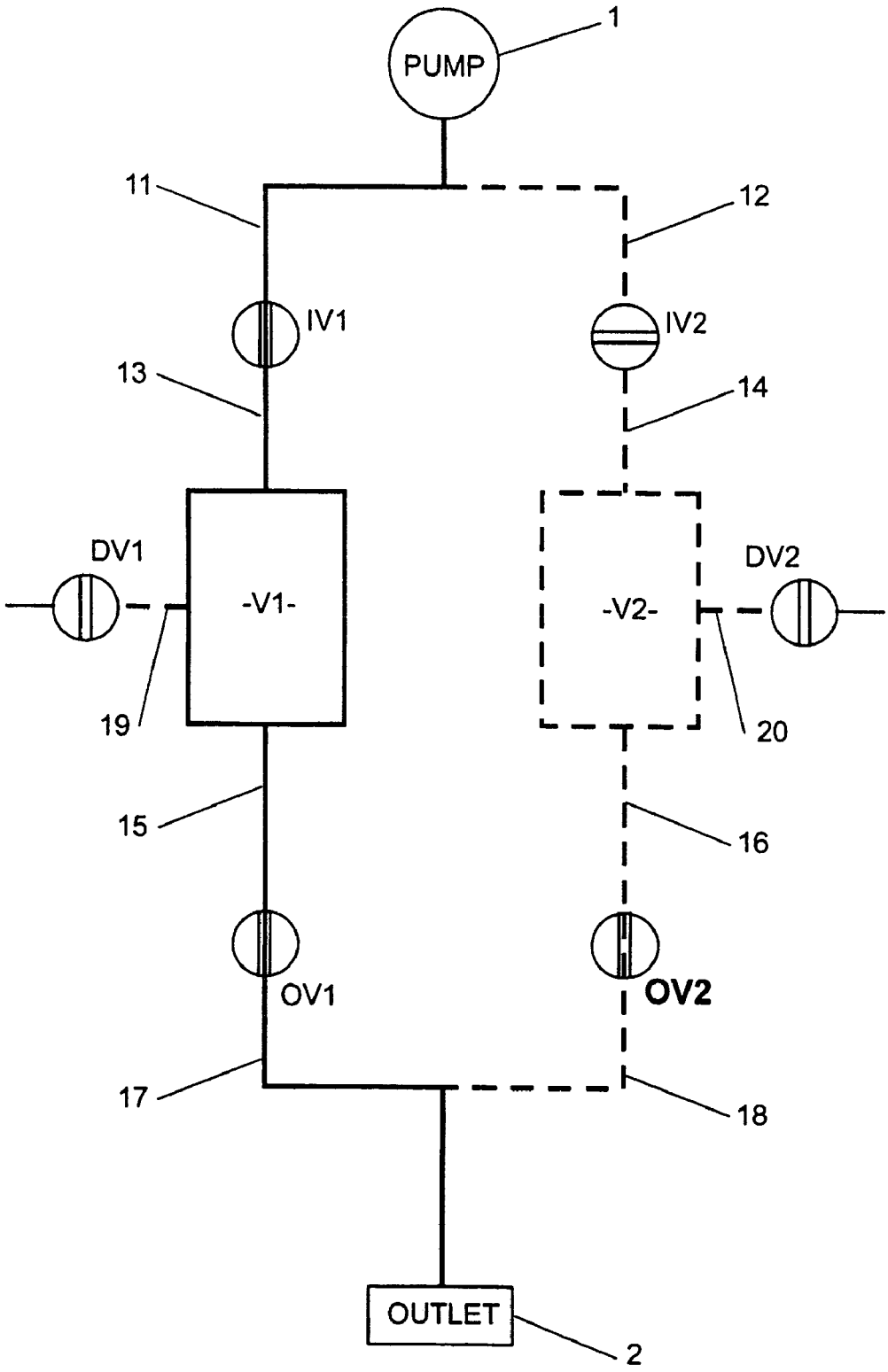

FIG. 1D shows an outlet valve opening stage. The second outlet valve OV2, labelled in bold in FIG. 1D, is now opened. It is to be appreciated that just before the opening of the second outlet valve OV2 there is no substantial pressure differential across the valve and, being closed, there is no flow through the valve. After opening, there is still no pressure differential across the valve and there is still no flow through the valve because there is no flow path through the second vessel V2 and its associated elements because the second inlet valve IV2 and the second depressurising valve DV2 are both closed, as shown in FIG. 1D. Therefore, the second outlet valve is opened without any substantial movement of abrasive slurry through the valve. This avoids the high-wear situation that would occur if abrasive material started to flow through the valve upon opening of the valve.

During and after opening of the second outlet valve OVB the pressurised flow from pump 1 to outlet 2, via the first vessel V1 and its associated elements, is still maintained, as shown by the continuous bold lines in FIG. 1D.

When the abrasive material in the first vessel V1 is almost fully discharged, the supply of abrasive slurry at the common outlet 2 is maintained by switching the pressurised fluid flowing from pump 1 to outlet 2 from the path through the first vessel 1 to the parallel path through the second vessel 2. This changeover is done without closing or opening any valves conducting abrasive material. In particular, the first and second outlet valves OV1, OV2 which convey the abrasive slurry are not opened or closed to achieve the changeover.

Figure 1E:
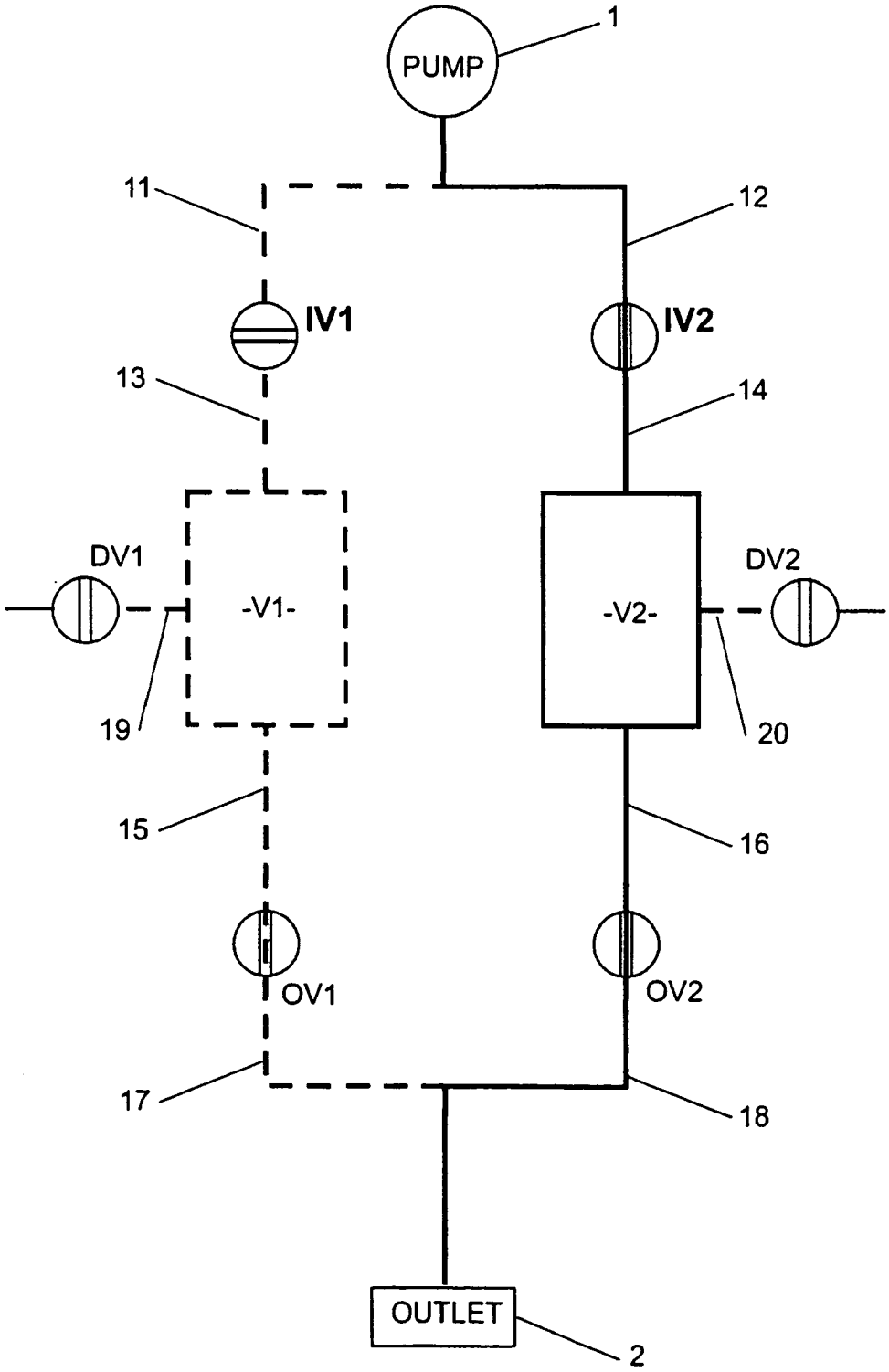

FIG. 1E shows the changeover of between the fluid flow paths. This changeover is effected by opening second inlet valve IV2 and, substantially simultaneously, closing first inlet valve IV1. These first and second inlet valves IV1, IV2 are labelled in bold in FIG. 1E. It is to be appreciated that these two inlet valves control pressure and flow in conduits that only carry clean carrier fluid. Little or no abrasive material flows through these two inlet valves so these valves can open and close without being subjected to excessive wear normally associated with abrasive flows.

The pressurised flow from pump 1 to outlet 2, via the first vessel V1 and its associated elements, has now ceased (because of the closing of the first inlet valve IV1) and has been replaced by a pressurised flow from pump 1 to outlet 2, via the second vessel V2 and its associated elements, as shown by the continuous bold lines in FIG. 1E. Thus, the uninterrupted flow of abrasive slurry at outlet 2 has been maintained while the changeover between the first and second vessels has been made.

As is shown by the broken bold lines in FIG. 1E, the first conduit 11, the first inlet valve IV1, the third conduit 13, the first vessel V1, the fifth conduit 15, the first outlet valve OV1, the seventh conduit 17 and the ninth conduit 19, all remain pressurised but no fluid flows through any of these elements. In particular there is no flow through first outlet valve OV1 because both the first inlet valve IV1 and first depressurising valve DV1 are closed.

Figure 1F:
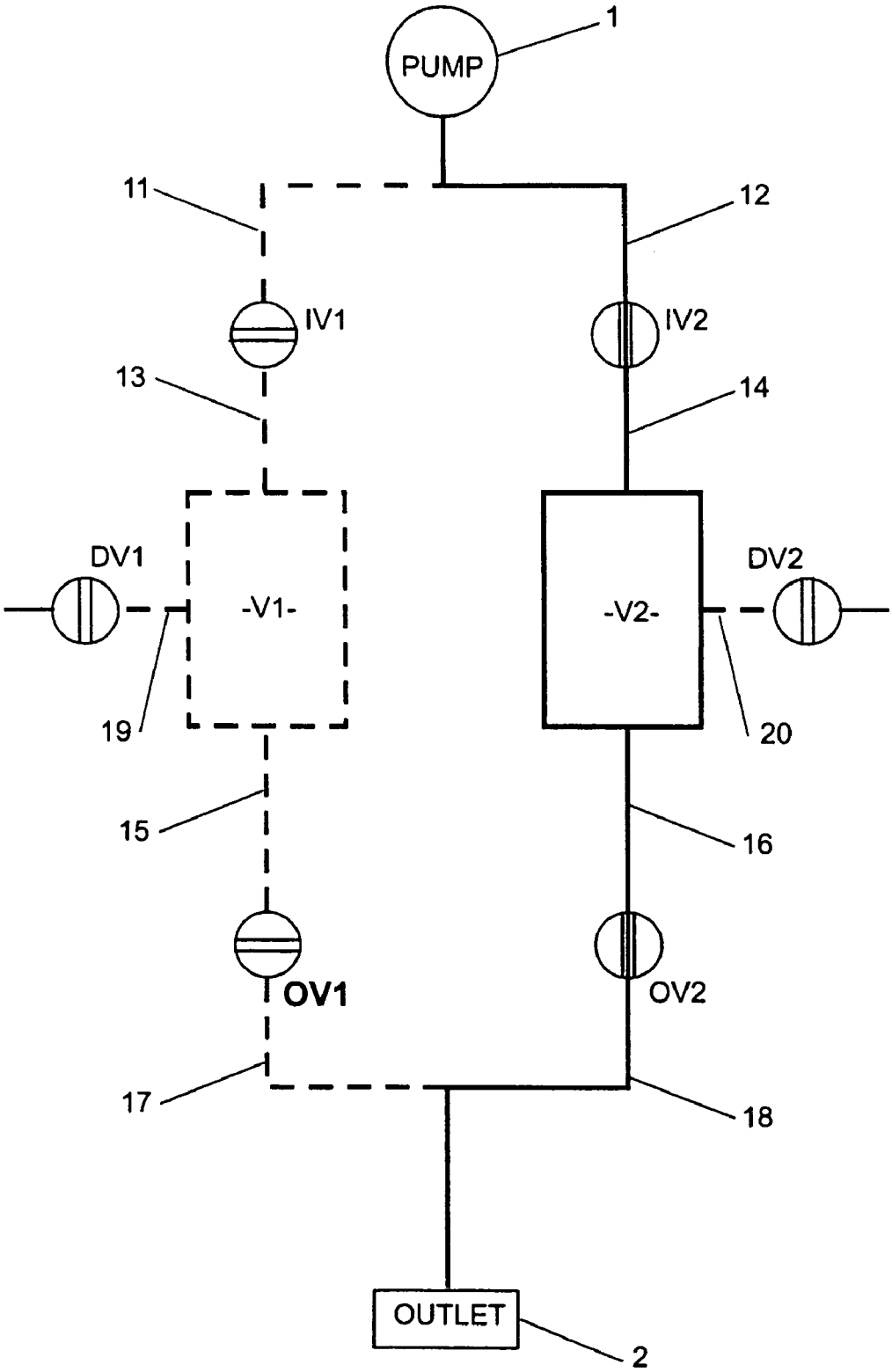

As shown in FIG. 1F, the first outlet valve OV1 is now closed. It is to be appreciated that just before the closing of the first outlet valve OV1, there is no flow through the first outlet valve (because the first inlet valve IV1 and the first depressurising valve DV1 are both closed) and there is no pressure differential across the first outlet valve OV1. After closing, there is still no flow through the valve and there is still no pressure differential across the valve. The first outlet valve is closed without any substantial movement of abrasive slurry through the valve. This avoids the high-wear situation that would occur if a flow of abrasive material had to be throttled and stopped upon closing of the valve.

With the first inlet valve IV1, the first outlet valve OV1 and the first depressurising valve DV1 all closed, the first vessel V1 and its associated elements are now isolated but remain pressurised, as shown by the bold broken lines in FIG. 1F. The pressurised flow from pump 1 to outlet 2, via the second vessel V2 and its associated elements, is maintained, as shown by the continuous bold lines in FIG. 1F.

Figure 1G:
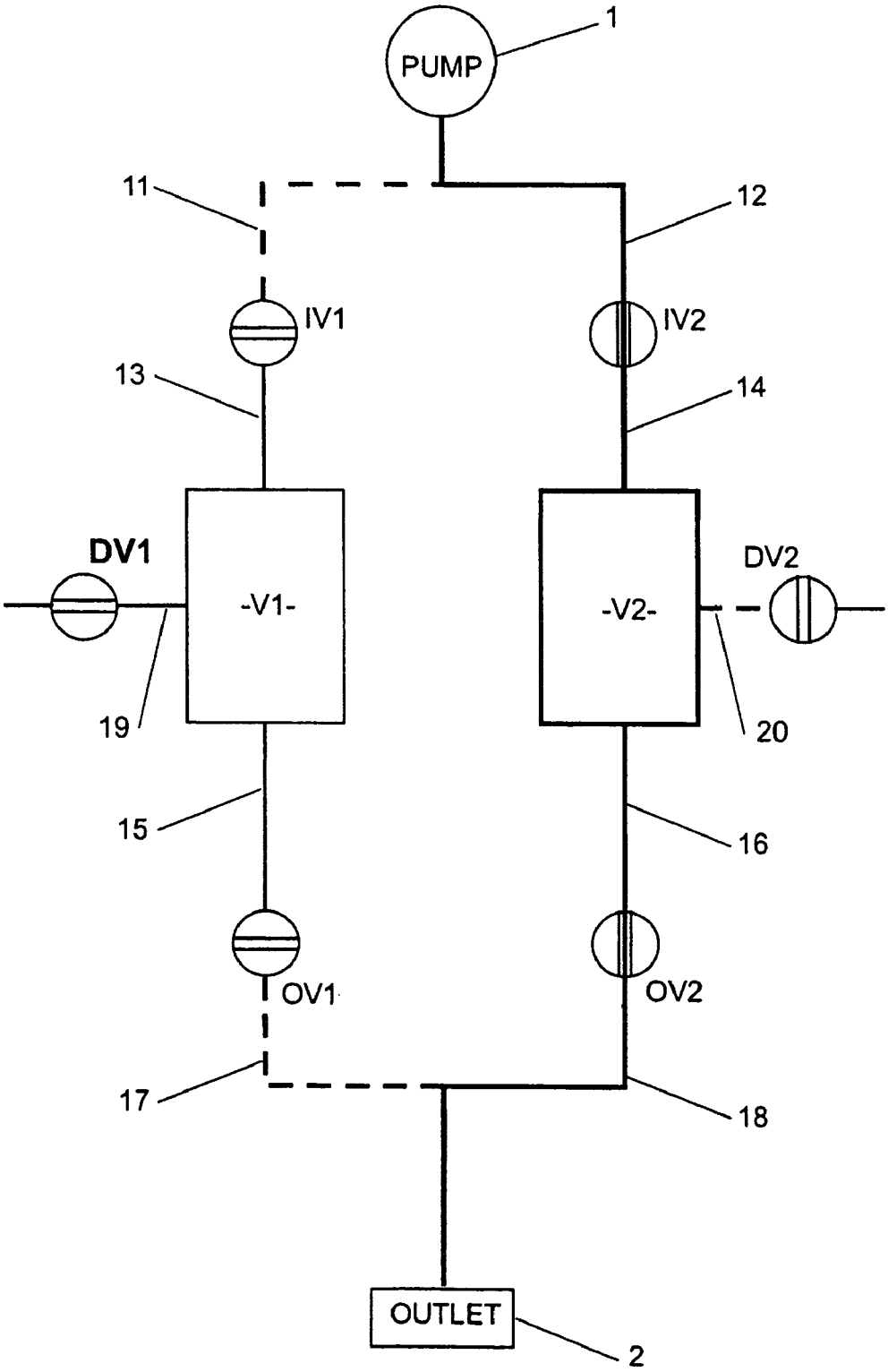

FIG. 1G shows a vessel depressurising stage. The now isolated first vessel V1 is depressurised by opening first depressurising valve DV1, labelled in bold in FIG. 1G. After the first vessel V1 is depressurised, it is recharged with abrasive material. During the depressurisation, the pressurised flow from pump 1 to outlet 2, via the second vessel V2 and its associated elements, is maintained, as shown by the continuous bold lines in FIG. 1G.

Figure 1H:
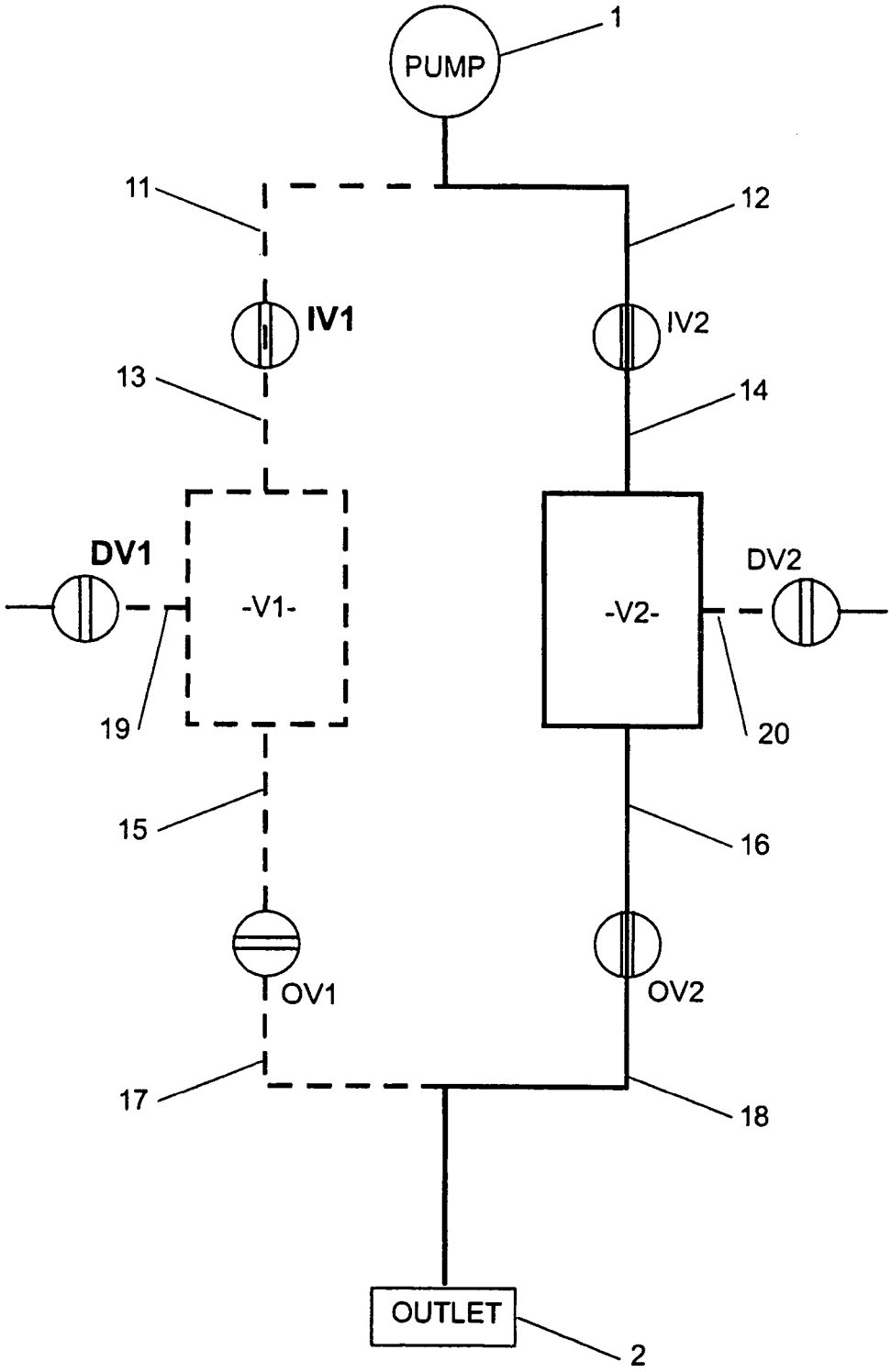

FIG. 1H shows the first vessel V1 which, having been recharged with abrasive material, is repressurised by closing the first depressurising valve DV1 (labelled in bold in FIG. 1H) and opening the first inlet valve IV1 (labelled in bold in FIG. 1H). This operation connects pressurised carrier fluid from the pump 1, via the first conduit 11 and the first inlet valve IV1, to the third conduit 13, the first vessel V1, the fifth conduit 15 and the ninth conduit 19. However, fluid flow through these elements is blocked by the first outlet valve OV1 and the first depressurising valve DV1, both of which are closed. It is to be noted that there is now no substantial pressure differential across the first outlet valve OV1 and no flow through it. The pressurised flow from pump 1 to outlet 2, via the second vessel V2 and its associated elements, is maintained, as shown by the continuous bold lines in FIG. 1H.

The further sequence of operations, for the changeover from the second vessel back to the first vessel as the supplier of abrasive material to the common outlet, corresponds to the description provided above for changeover from the first vessel to the second vessel.

In particular, it is to be noted that the source of the abrasive slurry being supplied to the common outlet 2 is alternately and successively switched between the two vessels V1, V2 by operation of the two inlet valves IV1, IV2 which are opened and closed on relatively clean and substantially abrasive-free carrier fluid. This switching is done while both outlet valves OV1, OV2 remain open. By using two vessels as described, or more vessels in a similar manner where at any one time one of the vessels is being recharged and another is discharging, an uninterrupted supply of an abrasive material can be maintained at a common outlet. Furthermore, each outlet valve is closed and opened only when there is no pressure differential across the valve and no flow through the valve, and more particularly when there is no abrasive flow through the valve. This reduces the wear normally associated with valves operated in conduits carrying abrasive slurry.

Figure 2:
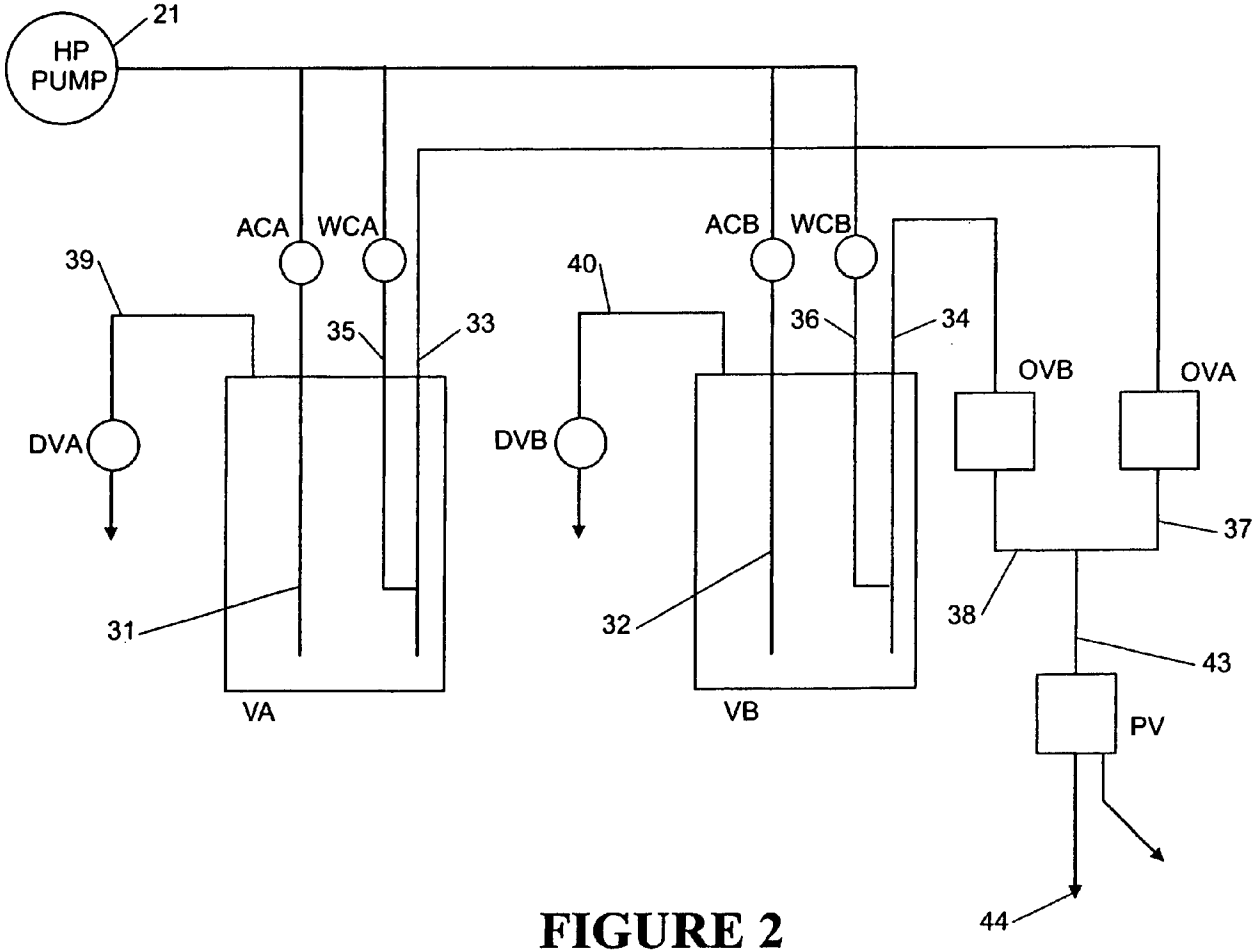
FIG. 2 shows schematically a second flow control system for providing an uninterrupted flow of abrasive fluid.

FIG. 2 shows schematically an alternative fluid flow control arrangement having a high pressure pump 21 which supplies high pressure water, as a carrier fluid, to a first abrasive control valve ACA, a first water control valve WCA, a second abrasive control valve ACB and a second water control valve WCB. The two abrasive control valves ACA, ACB are respectively connected to first and second inlet conduits 31, 32 which feed water to near the bottom of respective first and second vessels VA, VB. When the vessels VA, VB are charged with abrasive material and then fed with pressurised water via the first and second inlet conduits 31, 32, the water mixes with the abrasive material to form a slurry which is forced from the vessel via first and second outlet conduits 33, 34.

Two water control valves WCA, WCB are respectively connected to third and fourth inlet conduits 35, 36 which respectively feed water to near the bottom of inlet ends of the first and second outlet conduits 33, 34. This water mixes with the slurry formed in the vessels to increase the fluidity of the slurry being discharged from the vessels.

The first and second outlet conduits 33, 34 respectively connect the inlet ports of the two vessels VA, VB to first and second outlet valves OVA, OVB. The outlet ports of the outlet valves are respectively connected, via first and second outlet valve conduits 37, 38, to a common outlet conduit 43 which feeds abrasive slurry to a jet-forming nozzle 44 via a jet control valve PV.

Each vessel VA, VB is also respectively connected via first and second depressurising conduits 39, 40 to respective first and second depressurising valves DVA, DVB. These depressurising valves are opened when pressure in the respective vessel is to be lowered in readiness for recharging the vessel, e.g. from a hopper or other source at a lower, and typically atmospheric, pressure.

Figure 2A:
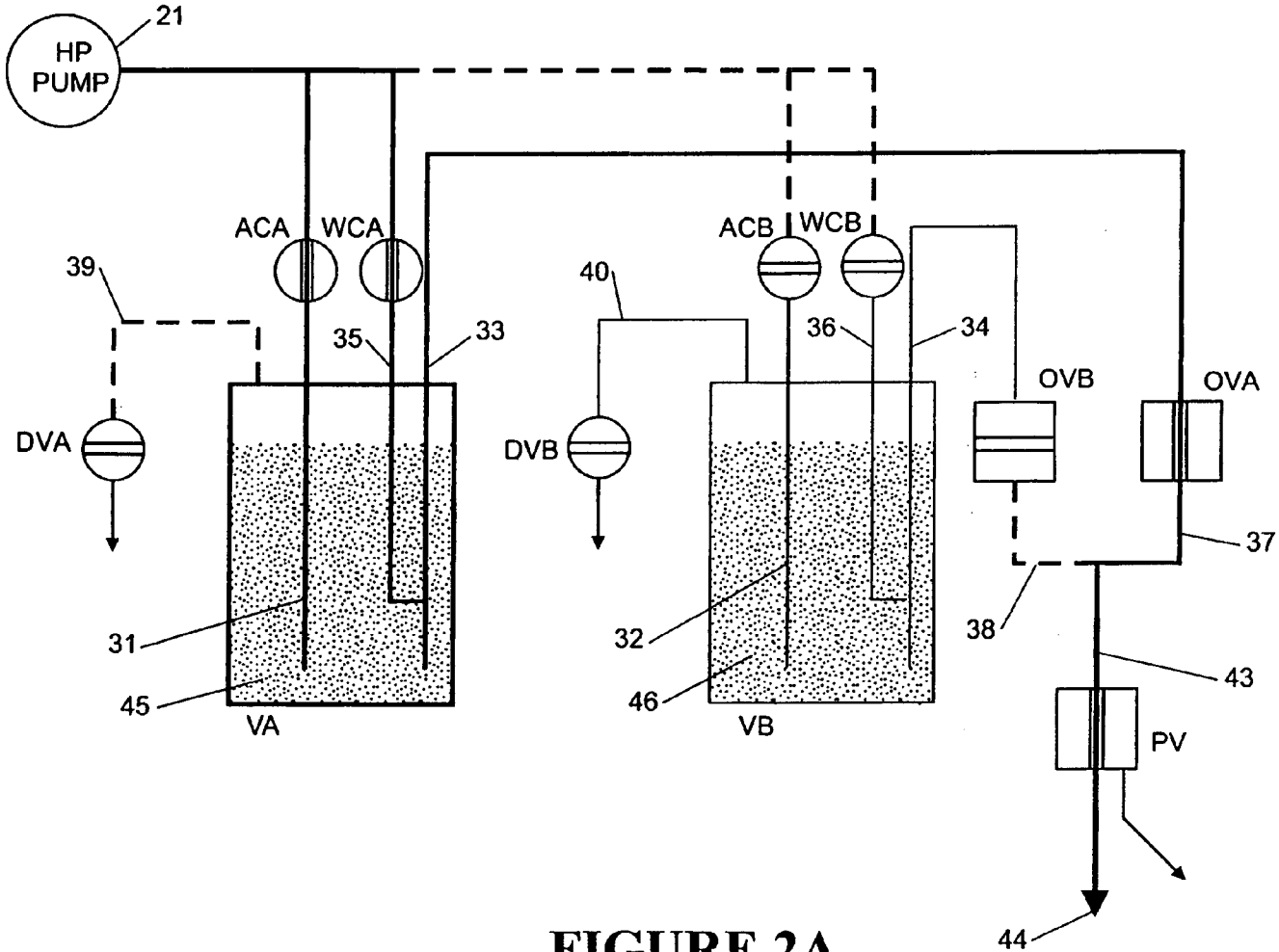
FIGS. 2A to 2H show schematically the second flow control system at various stages of control.

As in FIGS. 1, FIGS. 2A to 2H show various elements (i.e. the conduits, valves and vessels) with continuous bold lines to represent the flow of pressurised fluid through the respective elements, and with broken bold lines to represent other elements in which there is pressurised fluid without fluid flow. Elements not pressurised are shown in FIGS. 2A to AH by continuous thin lines. Furthermore, the valves that change status, i.e. are opened or closed, at each stage are labelled in bold in the corresponding figure.

In FIG. 2A, the first vessel VA has been previously charged with an abrasive material 45, such as a particulate. The abrasive material is denser than the carrier fluid (water) in the vessel and therefore tends to rest on the bottom of the vessel. The first vessel VA is pressurised with water from the high pressure pump 21 via the first abrasive control valve ACA, which is open, and the first inlet conduit 31. The first depressurising conduit 39 is pressurised with high pressure water from the top of the first vessel VA but flow through this depressurising conduit is blocked by the first depressurising valve DVA, which is closed.

The first outlet valve OVA is open allowing water to flow from the pump 21, through the first abrasive control valve ACA and the first inlet conduit 31 into the first vessel VA where it mixes with the abrasive material 45 to form a thick slurry. The slurry enters the lower inlet end of the first outlet conduit 33 where it is thinned by the introduction of high pressure water delivered from the pump 21 via the first water control valve WCA, which is open, and the third inlet conduit 35. The thinned slurry discharges from the first vessel VA via the first outlet conduit 33, the first outlet valve OVA (which is open), first outlet valve conduit 37, common outlet conduit 43, jet control valve PV and nozzle 44. This pressurised flow is shown by continuous bold lines in FIG. 2A and is maintained through the stages of operation shown in FIGS. 2A through 2D as explained further below.

Conduits leading from the pump 21 to the second vessel VB are pressurised by the pump with carrier fluid (water), but flow of fluid through these conduits is blocked by the second abrasive control valve ACB and the second water control valve WCB, both of which are closed. Accordingly, these conduits are shown in FIG. 2A by a broken bold line.

The second outlet valve conduit 38 (at the output port of the second outlet valve OVB) is pressurised with slurry from the first outlet valve conduit 37. However, fluid flow through the second outlet valve conduit 38 is blocked by the second outlet valve OVB which is closed. Accordingly, this second outlet valve conduit 38 is shown in FIG. 2A by a broken bold line.

While abrasive slurry from the first vessel VA is discharging at the outlet nozzle 44, the second vessel VB is isolated from pressurised fluids by the two inlet valves (i.e. the second abrasive control valve ACB and the second water control valve WCB) and the second outlet valve OVB, all three of which are closed. The isolated second vessel VB is initially depressurised by opening second depressurising valve DVB. After the second vessel VB is depressurised, it is recharged with abrasive material 46 and the second depressurising valve DVB closed, as is shown in FIG. 2A.

Figure 2B:
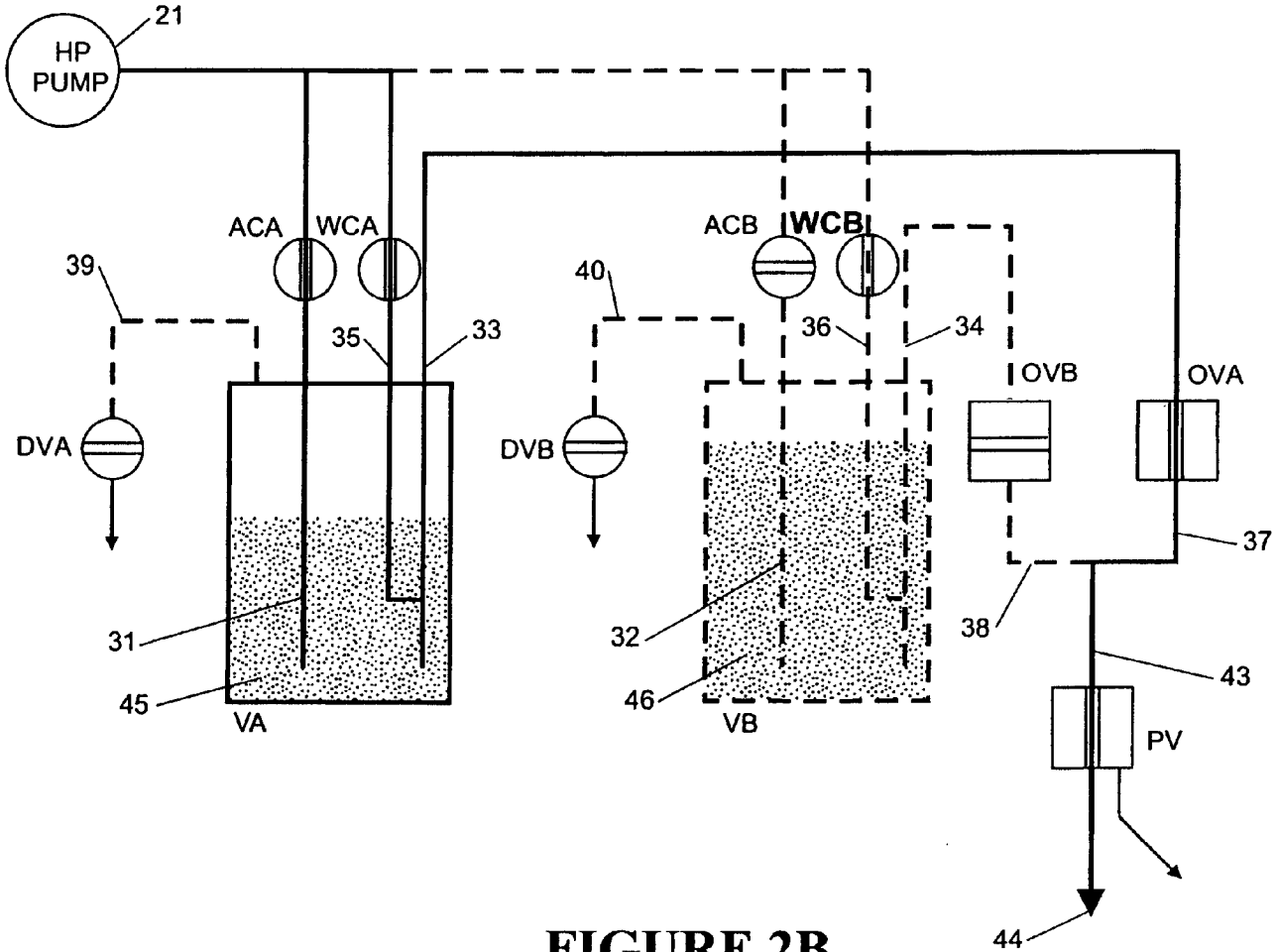

FIG. 2B shows the second vessel VB which, having been recharged with abrasive material 46, is re-pressurised by opening the second water control valve WCB, labelled in bold in FIG. 2B. This operation connects pressurised carrier fluid delivered from the pump 21 via the fourth inlet conduit 36 to the second vessel VB, the second outlet conduit 34, the second depressurising conduit 40 and the second inlet conduit 32. However, fluid flow through these elements is blocked by second outlet valve OVB, second depressurising valve DVB and second abrasive control valve ACB, all three of which are closed. It is to be noted that there is no substantial pressure differential across the second outlet valve OVB and no flow through it. The pressurised flow from pump 21 to outlet nozzle 44, via the first vessel VA and its associated elements, is maintained, as shown by the continuous bold lines in FIG. 2B. As a result of the continued discharge of abrasive slurry at the nozzle 44, the level of abrasive material 45 in the first vessel VA drops.

Figure 2C:
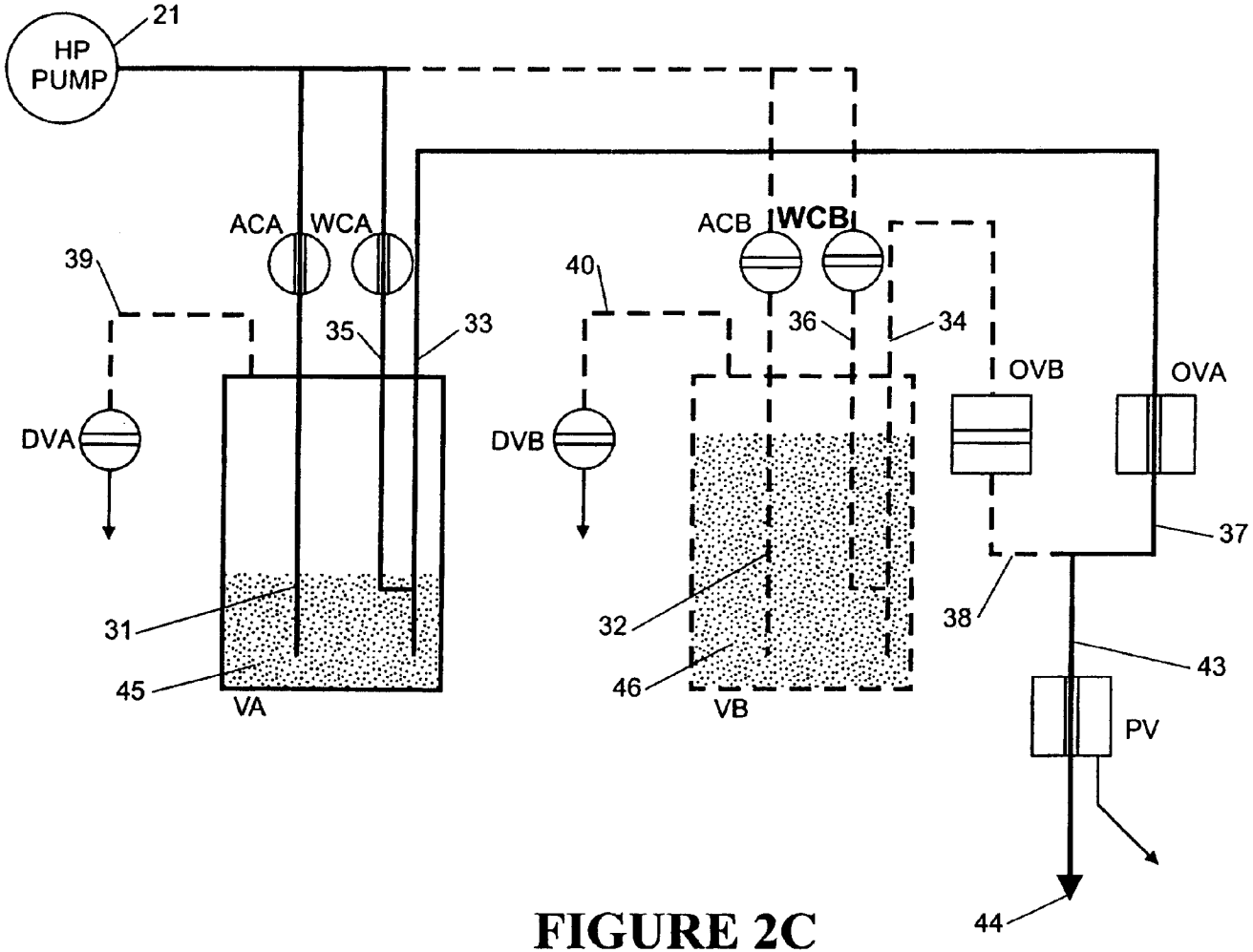

In FIG. 2C the second vessel is isolated. After re-pressurisation of the second vessel VB, the second water control valve WCB, labelled in bold in FIG. 2C, is closed. The second vessel VB is now isolated but pressurised to substantially the same pressure as that of the pressurised flow through the first vessel VA. There is no substantial pressure differential across the second outlet valve OVB. The pressurised flow from pump 21 to outlet nozzle 44, via the first vessel VA and its associated elements, is maintained, as shown by the continuous bold lines in FIG. 2C. The level of abrasive material 45 in the first vessel VA has dropped even further as a result of supplying the abrasive slurry discharged at the nozzle 44.

Figure 2D:
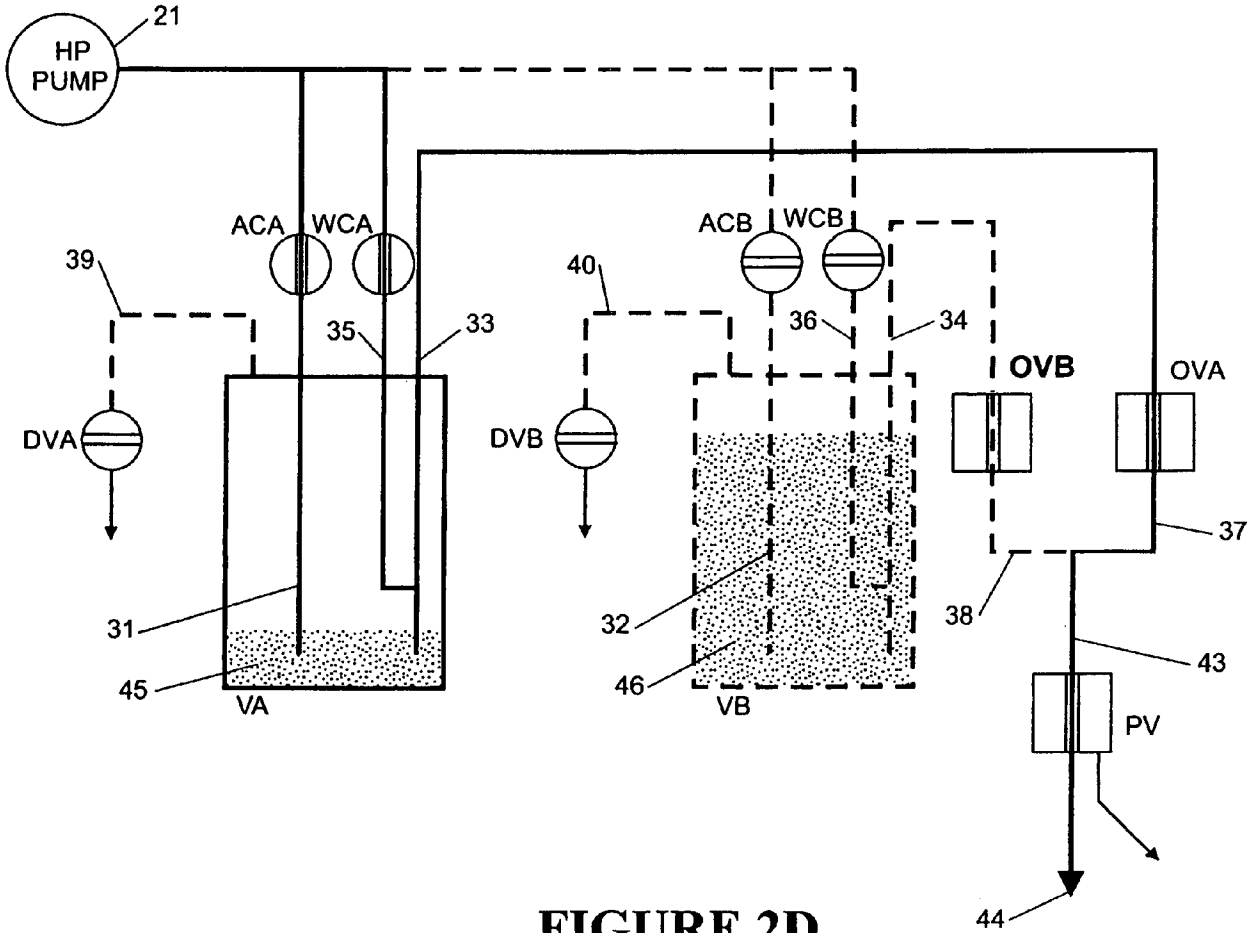

The second outlet valve OVB, labelled in bold in FIG. 2D, is now opened. It is to be appreciated that just before the opening of the second outlet valve OVB there is no substantial pressure differential across the valve and, being closed, there is no flow through the valve. After opening, there is still no pressure differential across the valve and there is still no flow through the valve because all three of the second abrasive control valve ACB, the second water control valve WCB and the second depressurising valve DVB are closed, as shown in FIG. 2D. Therefore, the second outlet valve OVB is opened without any substantial movement of abrasive slurry through the valve. This avoids the high-wear situation that would occur if abrasive material started to flow through the valve upon opening of the valve.

The pressurised flow from pump 21 to outlet nozzle 44, via the first vessel VA and its associated elements, is still maintained, as shown by the continuous bold lines in FIG.

2D. Meanwhile, the level of abrasive material 45 in the first vessel VA has dropped still further as a result of supplying the discharge of abrasive slurry at the nozzle 44.

When the abrasive material in the first vessel VA is almost fully discharged, the supply of abrasive slurry at the outlet nozzle 44 is maintained by switching the flow of pressurised fluid from pump 21 to nozzle 44 from the path through the first vessel VA to the parallel path through the second vessel VB. This changeover is done without closing or opening any valves passing abrasive material. In particular, the first and second outlet valves OVA, OVB which convey the abrasive slurry are not opened or closed to achieve the changeover.

Figure 2E:
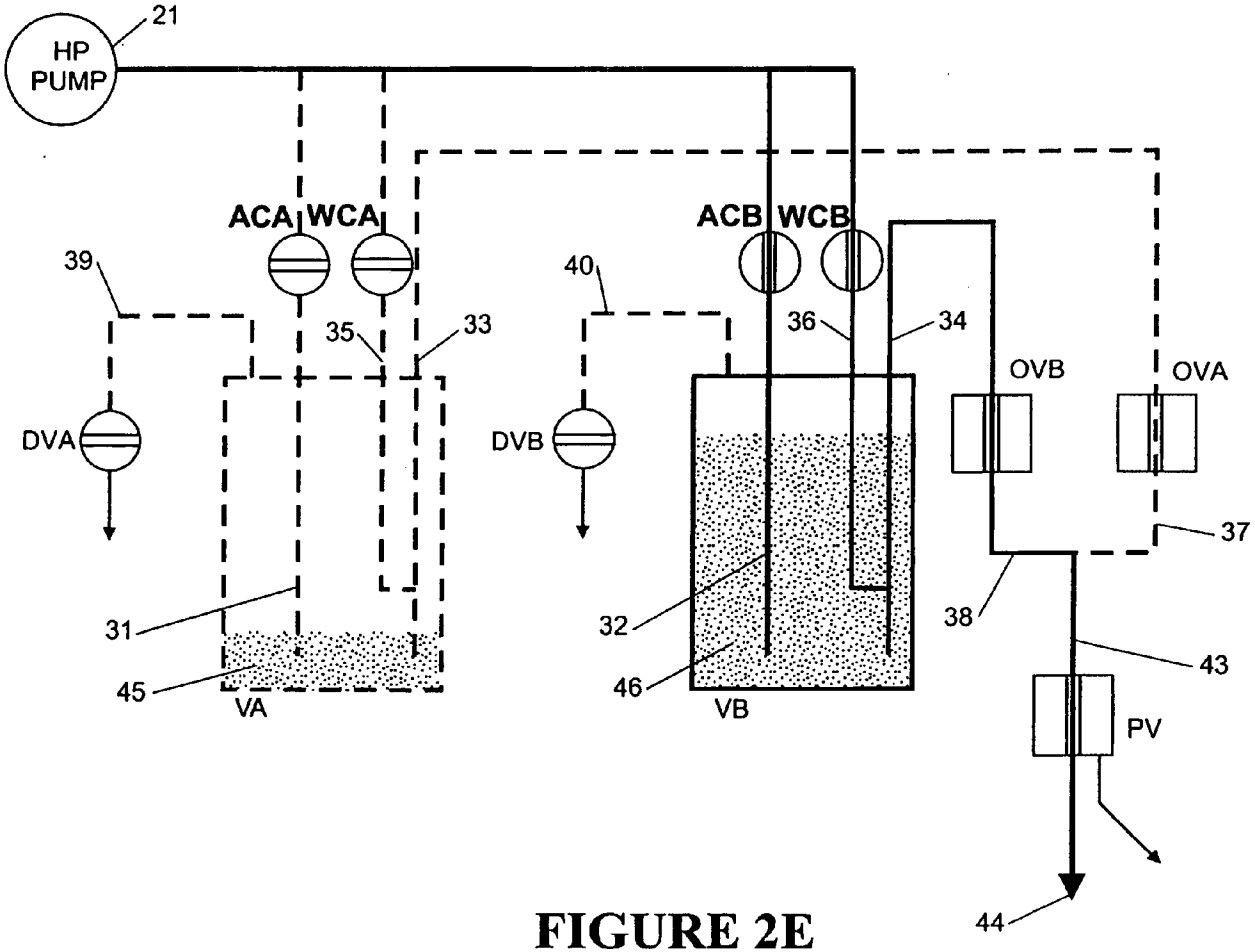

As shown in FIG. 2E, this changeover is effected by opening both the second abrasive control valve ACB and the second water control valve WCB, and closing both the first abrasive control valve ACA and the first water control valve WCA. The respective opening and closing of these four vessel inlet control valves is performed substantially simultaneously. These first and second abrasive and water control valves ACA, ACB, WCA, WCB are labelled in bold in FIG. 2E. It is to be appreciated that these four inlet valves control pressure and flow in conduits that only carry relatively clean water. Little or no abrasive material flows through these four inlet valves so these valves can open and close without being subjected to excessive wear normally associated with abrasive flows.

The pressurised flow from the pump 21 to the nozzle 44, via the first vessel VA and its associated elements, has now ceased (because of the closing of the first abrasive control valve ACA and the first water control valve WCA) and has been replaced by a pressurised flow from the pump 21 to the nozzle 44, via the second vessel VB and its associated elements, as shown by the continuous bold lines in FIG. 2E. Thus, the uninterrupted flow of abrasive slurry at the nozzle 44 has been maintained while the changeover between the first and second vessels has been made.

As is shown by the broken bold lines in FIG. 2E, the first abrasive control valve ACA, the first water control valve WCA, the first and third inlet conduits 31, 35, the first vessel VA, the first outlet conduit 33, the first outlet valve OVA, the first outlet valve conduit 37 and the first depressurising conduit 39, all remain pressurised but no fluid flows through any of these elements. In particular there is no flow through first outlet valve OVA because all three of the other valves (i.e. the first abrasive control valve ACA, the first water control valve WCA and the first depressurising valve DVA) associated with the first vessel VA are closed.

Figure 2F:
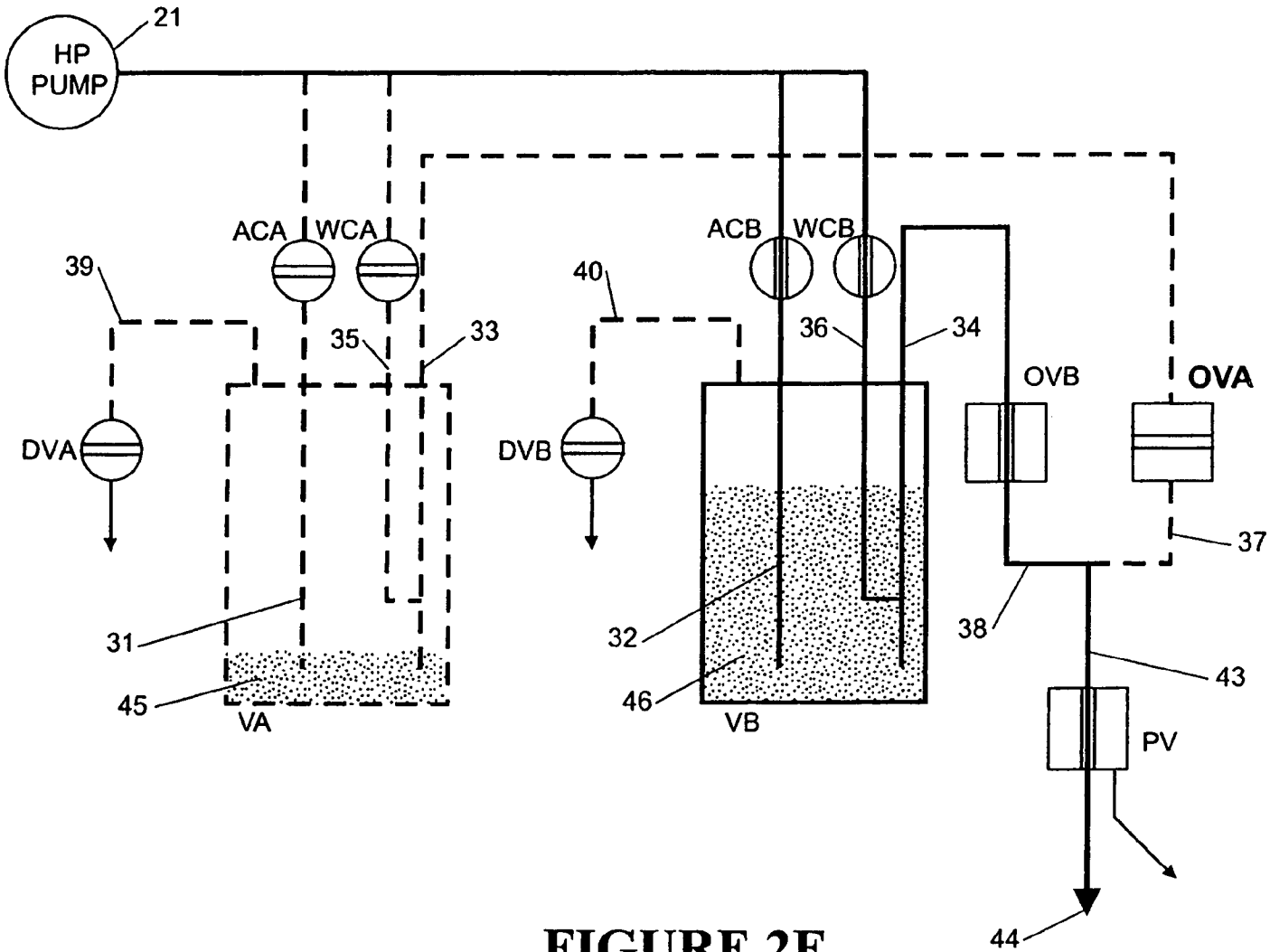

At the next stage, shown in FIG. 2F, the first outlet valve OVA (labelled in bold in FIG. 2F) is now closed. It is to be appreciated that just before the closing of the first outlet valve OVA, there is no flow through the valve (because the first abrasive control valve ACA, and the first water control valve WCA and the first depressurising valve DV1 are all closed) and there is no pressure differential across the valve. After closing, there is still no flow through the valve and there is still no pressure differential across the valve. Therefore, the first outlet valve OVA is closed without any substantial movement of abrasive slurry through the valve. This avoids the high-wear situation that would occur if a flow of abrasive material had to be throttled and stopped by closing of the valve.

With the first abrasive control valve ACA, the first water control valve WCA, the first outlet valve OVA and the first pressurising valve DVA all closed, the first vessel VA and its associated elements are now isolated but remain pressurised, as shown by the bold broken lines in FIG. 2F. The pressurised flow from pump 21 to outlet nozzle 44, via the second vessel VB and its associated elements, is maintained, as shown by the continuous bold lines in FIG. 2F.

Figure 2G:
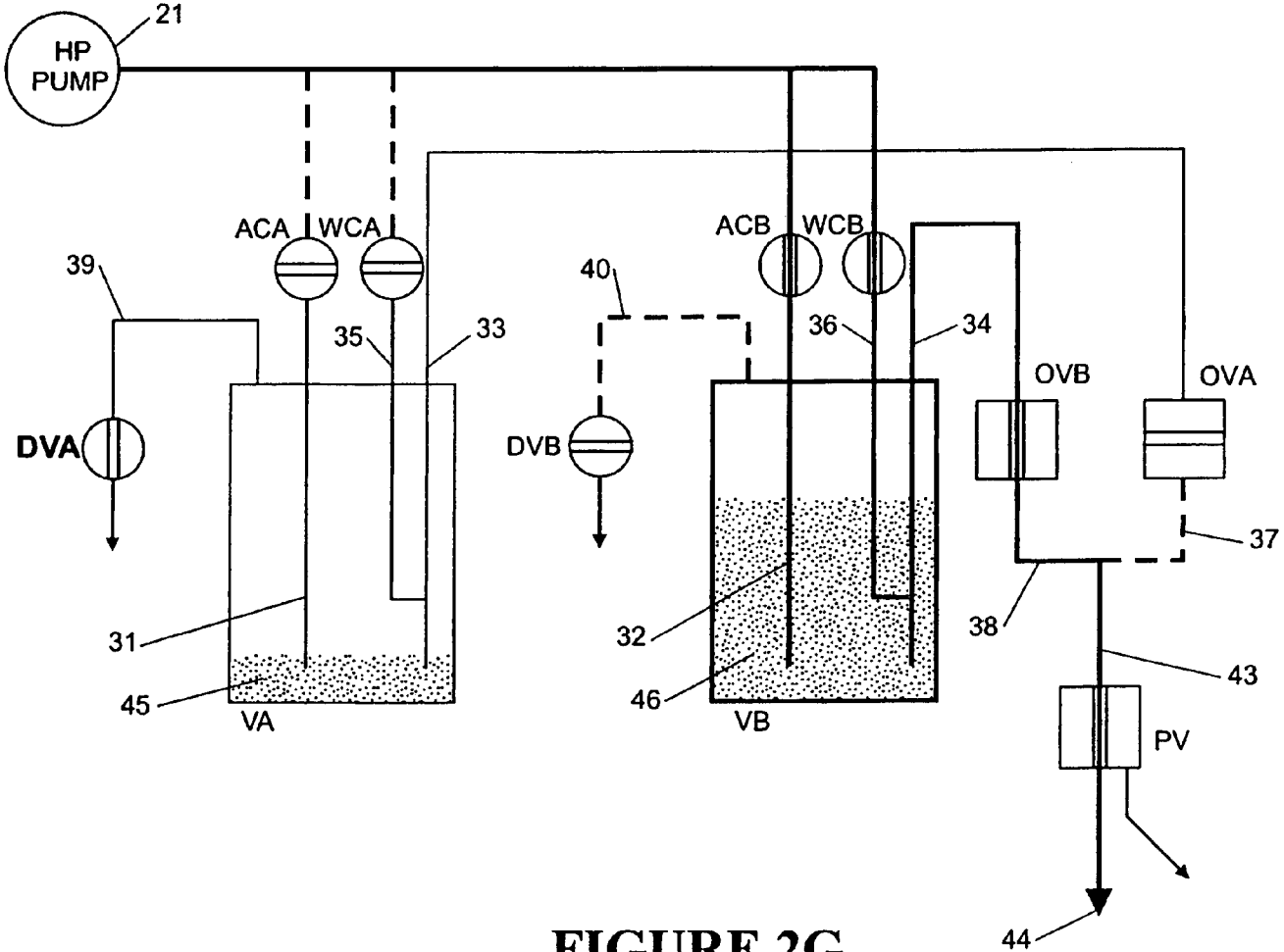

FIG. 2G shows depressurisation of the first vessel VA. The now isolated first vessel VA is depressurised by opening first depressurising valve DVA, labelled in bold in FIG. 2G. After the first vessel is depressurised, it is recharged with abrasive material. The pressurised flow from pump 21 to outlet nozzle 44, via the second vessel VB and its associated elements, is maintained, as shown by the continuous bold lines in FIG. 2G.

Figure 2H:
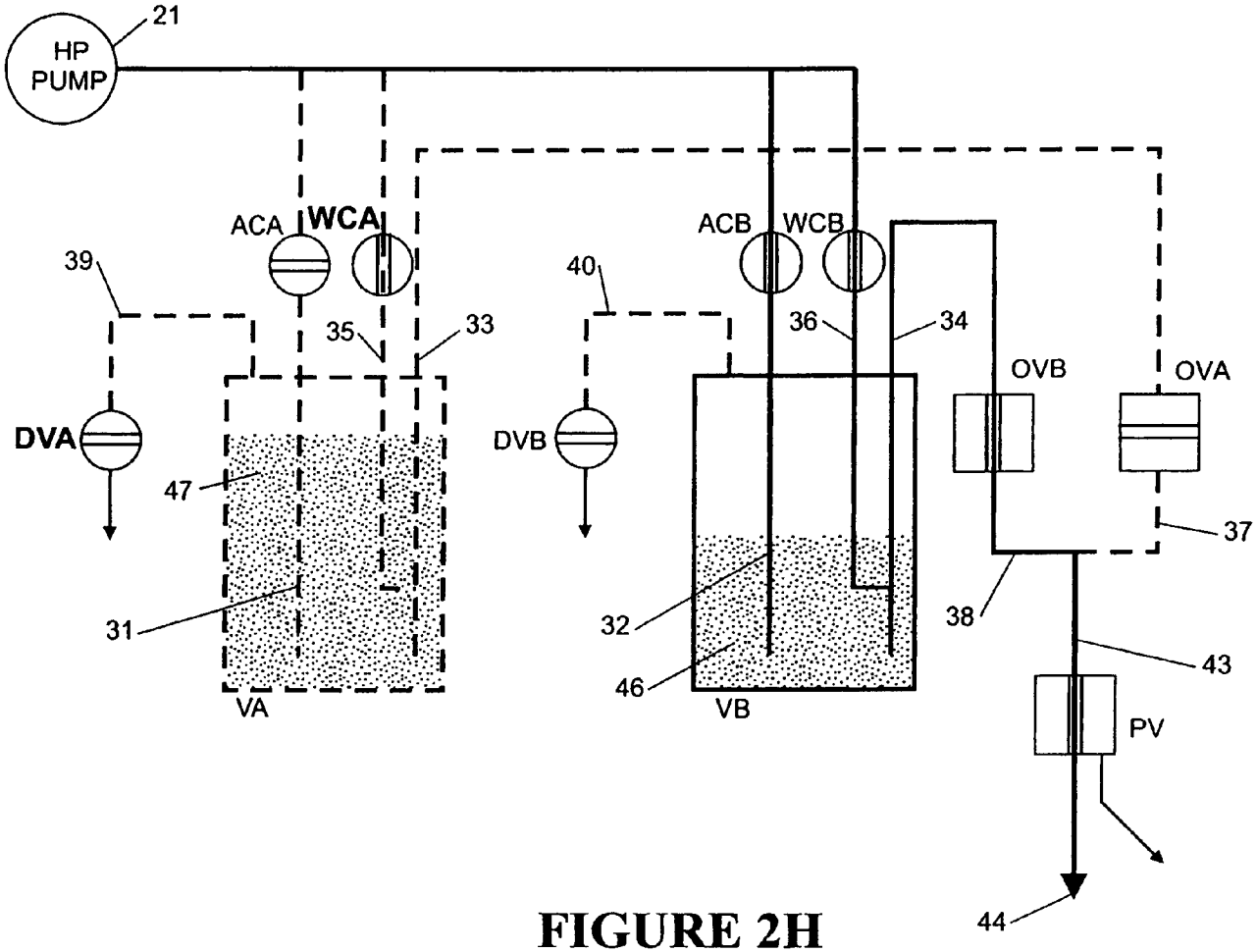

FIG. 2H shows the first vessel VA which, having been recharged with abrasive material 47, is re-pressurised by closing the first depressurising valve DVA (labelled in bold in FIG. 2H) and opening the first water control valve WCA (labelled in bold in FIG. 2H). This latter operation connects pressurised carrier fluid from the pump 21 to the third inlet conduit 35, the first vessel VA, the first inlet conduit 31, the first outlet conduit 33 and the first depressurising conduit 39. However, fluid flow through these elements is blocked by the first outlet valve OVA, the first abrasive control valve ACA, and first depressurising valve DVA, all three of which are closed. It is to be noted that there is now no substantial pressure differential across the first outlet valve OVA and no flow through it. The pressurised flow from pump 21 to outlet nozzle 44, via the second vessel VB and its associated elements, is maintained, as shown by the continuous bold lines in FIG. 2H. The level of abrasive material 46 in the second vessel VB drops as a result of supplying the discharge of slurry at the nozzle 44.

The further sequence of operations, for the changeover from the second vessel VB back to the first vessel VA as the supplier of abrasive material to the common outlet nozzle 44, corresponds to the description provided above for changeover from the first vessel VA to the second vessel VB.

In particular, it is to be noted that the source of the abrasive slurry being supplied to the common outlet nozzle 44 is switched between the two vessels VA, VB by operation of the four inlet valves (i.e. the first and second abrasive control valves ACA, ACB and the first and second water control valves WCA, WCB) which are opened and closed on relatively clean and substantially abrasive-free carrier water. This switching is done while both outlet valves OVA, OVB remain open. Each outlet valve is closed and opened only when there is no pressure differential across the valve and no flow through the valve, and more particularly when there is no abrasive flow through the valve.

Flows of abrasive slurry downstream of the abrasive storage vessels are switched by controlling clean upstream flows of a carrier liquid. This vessel switching is achieved without having to open or close any valve in the downstream flow while the valve carries the slurry or while the valve is exposed to a pressure differential.

In both embodiments described above, any wear of the valves (and particularly wear of the outlet valves which carry abrasive material) can be further reduced by using wear-tolerant valves, e.g. valves having a flat self-lapping sprung-biased valve seat which moves back and forth across a wear plate. However, the present invention is not confined to the use of any particular valve but rather relates to systems in which valves carrying abrasive flow are not opened or closed under conditions of fluid flow or pressure differential.

Also not part of the invention is the inclusion of a jet control valve, e.g. valve PV shown in FIG. 2. This valve may be used to control the jet, or to switch the jet on or off, by diverting the uninterrupted flow of abrasive slurry at the common outlet conduit 43 to an alternative discharge conduit and thereby bypass the outlet nozzle 44.

The foregoing describes the invention including preferred forms thereof. Alterations and modifications as will be obvious to those skilled in the art are intended to be incorporated within the scope hereof as defined in the accompanying claims.

For example, the number of vessels that are successively recharged with abrasive material for subsequent supply of abrasive slurry can be more than the two shown in the figures. A greater number of vessels will be appropriate in cases where the maximum duration of a continuous discharge of abrasive slurry from a single vessel is shorter than the time required to recharge the vessel, or where the reliability of the continuous supply of slurry must not be compromised if a vessel and its associated elements need to be taken out of the normal succession, e.g. for maintenance or repair.

Furthermore, although the preferred embodiments described above refer to the carrier fluid being water, it is to be understood that other liquids and gases may be used as the carrier fluid for mixing with and entraining the abrasive material to form the abrasive slurry. The slurry can be either wet or dry.

The term "slurry" used in this description and in the following claims is to be understood as including suspensions of insoluble particles in a carrier fluid where the fluid can be liquid or gaseous. Water and air are suitable carrier fluids for many applications of the invention.

Although the embodiment described with reference to FIG. 2 to 2H includes a single nozzle 44, the substantially uninterrupted flow can be supplied to more than one nozzle so that each nozzle produces an abrasive cutting jet.

List of Features Labelled in FIGS. 1 to 1H

1 pump
2 common outlet
11 first conduit
12 second conduit
13 third conduit
14 fourth conduit
15 fifth conduit
16 sixth conduit
17 seventh conduit
18 eighth conduit
19 ninth conduit
20 tenth conduit
DV1 first depressurising valve
DV2 second depressurising valve
IV1 first inlet valve
IV2 second inlet valve
OV1 first outlet valve
OV2 second outlet valve
V1 first vessel
V2 second vessel List of Features Labelled in FIGS. 2 to 2H

21 high pressure pump
31 first inlet conduit
32 second inlet conduit
33 first outlet conduit
34 second outlet conduit
35 third inlet conduit
36 fourth inlet conduit
37 first outlet valve conduit
38 second outlet valve conduit
39 first depressurising conduit
40 second depressurising conduit
43 common outlet conduit
44 nozzle
45 abrasive material
46 abrasive material
47 abrasive material
ACA first abrasive control valve
ACB second abrasive control valve
DVA first depressurising valve
DVB second depressurising valve
OVA first outlet valve
OVB second outlet valve
PV jet control valve
VA first vessel
VB second vessel
WCA first water control valve
WCB second water control valve

The invention claimed is:

1. A method of maintaining a substantially uninterrupted flow of a pressurised abrasive slurry, the method including the steps of:

(a) discharging abrasive slurry from one vessel of a plurality of vessels while charging another of the plurality of vessels with an abrasive material, (b) successively repeating step (a) to recharge each vessel in turn with abrasive material while alternately discharging abrasive slurry from each vessel in turn, and (c) passing the abrasive slurry discharged from the vessels through respective flow-controlling outlet valves to a common outlet at which the substantially uninterrupted flow is maintained, wherein a position of each of the outlet valves is not changed from i) an opened to a closed position or ii) from a closed to an open position unless there is substantially no pressure differential across the valve and substantially no flow through the valve.

2. A method as claimed in claim 1, wherein the outlet valve of the vessel being recharged with abrasive material is closed to isolate that vessel from the common outlet while that vessel is being recharged but is subsequently open to allow that vessel to discharge abrasive slurry.

3. A method as claimed in claim 1, wherein the vessels are fed from a common source of pressurised carrier fluid via respective flow-controlling inlet valves, so that the carrier fluid is introduced to each vessel and combined with the abrasive material to form the abrasive slurry.

4. A method as claimed in claim 2, wherein the vessels are fed from a common source of pressurised carrier fluid via respective flow-controlling inlet valves, so that the carrier fluid is introduced to each vessel and combined with the abrasive material to form the abrasive slurry.

5. A method as claimed in claim 3, wherein after each vessel is recharged with abrasive material the recharged vessel is pressurised and then, after switching with a previously-discharging vessel, is discharged, by the following sequence of steps:

(d) pressurised the recharged vessel by opening the inlet valve of the recharged vessel while maintaining the outlet valve of the recharged vessel closed, (e) closing the inlet valve of the recharged vessel, (f) opening the outlet valve of the recharged vessel, (g) switching the previously-discharging vessel with the recharged vessel by opening the inlet valve of the recharged vessel and closing the inlet valve of the previously-discharging vessel, and (h) closing the outlet valve of the previously-discharging vessel.

6. A method as claimed in claim 4, wherein after each vessel is recharged with abrasive material the recharged vessel is pressurised and then, after switching with a previously-discharging vessel, is discharged, by the following sequence of steps;

(d) pressurising the recharged vessel by opening the inlet valve of the recharged vessel while maintaining the outlet valve of the recharged vessel closed, (e) closing the inlet valve of the recharged vessel, (f) opening the outlet valve of the recharged vessel, (g) switching the previously-discharging vessel with the recharged vessel by opening the inlet valve of the recharged vessel and closing the inlet valve of the previously-discharging vessel, and (h) closing the outlet valve of the previously-discharging vessel.

7. A method as claimed in claim 5, wherein the previously-discharging vessel is depressurised, recharged with abrasive material, and re-pressurised in readiness for a later discharge of abrasive slurry from the previously-discharging vessel, by following step (h) with the following sequence of steps:

(i) opening a depressurising valve of the previously-discharging vessel, (j) recharging the previously-discharging vessel with abrasive material, (k) closing the depressurising valve of the previously-discharging vessel, (l) pressurising the previously-discharging vessel by opening the inlet valve of the previously-discharging vessel while maintaining the outlet valve of the previously-discharging vessel closed, (m) closing the inlet valve of the previously-discharging vessel, and (n) opening the outlet valve of the previously-discharging vessel.

8. A method as claimed in claim 6, wherein the previously-discharging vessel is depressurised, recharged with abrasive material, and re-pressurised in readiness for a later discharge of abrasive slurry from the previously-discharging vessel, by following step (h) with the following sequence of steps:

(i) opening a depressurising valve of the previously-discharging vessel, (j) recharging the previously-discharging vessel with abrasive material, (k) closing the depressurising valve of the previously-discharging vessel, (l) pressurising the previously-discharging vessel by opening the inlet valve of the previously-discharging vessel while maintaining the outlet valve of the previously-discharging vessel closed, (m) closing the inlet valve of the previously-discharging vessel, and (n) opening the outlet valve of the previously-discharging vessel.

9. A method as claimed in claim 3, wherein each vessel has an inlet conduit for feeding pressurised carrier fluid into the vessel and an outlet conduit for feeding abrasive slurry from the vessel to its outlet valve, and each vessel is fed from the common source of pressurised carrier fluid via a respective pair of flow-controlling inlet valves, a first valve of the pair being an abrasive flow control valve which connects the pressurised carrier fluid supply to the inlet conduit for pressurising the vessel and forcing abrasive material from the vessel via the outlet conduit, and the second valve of the pair being a carrier fluid control valve which connects the pressurised carrier fluid supply via an intermediate conduit to the outlet conduit where the carrier fluid mixes with the abrasive material to form the abrasive slurry.

10. A method as claimed in claim 4, wherein each vessel has an inlet conduit for feeding pressurised carrier fluid into the vessel and an outlet conduit for feeding abrasive slurry from the vessel to its outlet valve, and each vessel is fed from the common source of pressurised carrier fluid via a respective pair of flow-controlling inlet valves, a first valve of the pair being and abrasive flow control valve which connects the pressurised carrier fluid supply to the inlet conduit for pressurising the vessel and forcing abrasive material from the vessel via the outlet conduit, and the second valve of the pair being a carrier fluid control valve which connects the pressurised carrier fluid supply via an intermediate conduit to the outlet conduit where the carrier fluid mixes with the abrasive material to form the abrasive slurry.

11. A method as claimed in claim 5, wherein each vessel has an inlet conduit for feeding pressurised carrier fluid into the vessel and an outlet conduit for feeding abrasive slurry from the vessel to its outlet valve, and each vessel is fed from the common source of pressurised carrier fluid via a respective pair of flow-controlling inlet valves, a first valve of the pair being an abrasive flow control valve which connects the pressurised carrier fluid supply to the inlet conduit for pressurising the vessel and forcing abrasive material from the vessel via the outlet conduit, and the second valve of the pair being a carrier fluid control valve which connects the pressurised carrier fluid supply via an intermediate conduit to the outlet conduit where the carrier fluid mixes with the abrasive material to form the abrasive slurry.

12. A method as claimed in claim 6, wherein each vessel has an inlet conduit for feeding pressurised carrier fluid into the vessel and an outlet conduit for feeding abrasive slurry from the vessel to its outlet valve, and each vessel is fed from the common source of pressurised carrier fluid via a respective pair of flow-controlling inlet valves, a first valve of the pair being an abrasive flow control valve which connects the pressurised carrier fluid supply to the inlet conduit for pressurising the vessel and forcing abrasive material from the vessel via the outlet conduit, and the second valve of the pair being a carrier fluid control valve which connects the pressurised carrier fluid supply via an intermediate conduit to the outlet conduit where the carrier fluid mixes with the abrasive material to form the abrasive slurry.

13. A method as claimed in claim 7, wherein each vessel has an inlet conduit for feeding pressurised carrier fluid into the vessel and an outlet conduit for feeding abrasive slurry from the vessel to its outlet valve, and each vessel is fed from the common source of pressurised carrier fluid via a respective pair of flow-controlling inlet valves, a first valve of the pair being an abrasive flow control valve which connects the pressurised carrier fluid supply to the inlet conduit for pressurising the vessel and forcing abrasive material from the vessel via the outlet conduit, and the second valve of the pair being a carrier fluid control valve which connects the pressurised carrier fluid supply via an intermediate conduit to the outlet conduit where the carrier fluid mixes with the abrasive material to form the abrasive slurry.

14. A method as claimed in claim 8, wherein each vessel has an inlet conduit for feeding pressurised carrier fluid into the vessel and an outlet conduit for feeding abrasive slurry from the vessel to its outlet valve, and each vessel is fed from the common source of pressurised carrier fluid via a respective pair of flow-controlling inlet valves, a first valve of the pair being an abrasive flow control valve which connects the pressurised carrier fluid supply to the inlet conduit for pressurising the vessel and forcing abrasive material from the vessel via the outlet conduit, and the second valve of the pair being a carrier fluid control valve which connects the pressurised carrier fluid supply via an intermediate conduit to the outlet conduit where the carrier fluid mixes with the abrasive material to form the abrasive slurry.

15. A method as claimed in claim 1, wherein the common outlet is one or more nozzles, each of which is for forming at least a portion of the uninterrupted flow of pressurised abrasive slurry into a defined jet.

16. A method as claimed in claim 2, wherein the common outlet is one or more nozzles, each of which is for forming at least a portion of the uninterrupted flow of pressurised abrasive slurry into a defined jet.

17. A method as claimed in claim 3, wherein the common outlet is one or more nozzles, each of which is for forming at least a portion of the uninterrupted flow of pressurised abrasive slurry into a defined jet.

18. A method as claimed in claim 4, wherein the common outlet is one or more nozzles, each of which is for forming at least a portion of the uninterrupted flow of pressurised abrasive slurry into a defined jet.

19. A method as claimed in claim 5, wherein the common outlet is one or more nozzles, each of which is for forming at least a portion of the uninterrupted flow of pressurised abrasive slurry into a defined jet.

20. A method as claimed in claim 6, wherein the common outlet is one or more nozzles, each of which is for forming at least a portion of the uninterrupted flow of pressurised abrasive slurry into a defined jet.

21. A method as claimed in claim 7, wherein the common outlet is one or more nozzles, each of which is for forming at least a portion of the uninterrupted flow of pressurised abrasive slurry into a defined jet.

22. A method as claimed in claim 8, wherein the common outlet is one or more nozzles, each of which is for forming at least a portion of the uninterrupted flow of pressurised abrasive slurry into a defined jet.

23. A method as claimed in claim 9, wherein the common outlet is one or more nozzles, each of which is for forming at least a portion of the uninterrupted flow of pressurised abrasive slurry into a defined jet.

24. A method as claimed in claim 10, wherein the common outlet is one or more nozzles, each of which is for forming at least a portion of the uninterrupted flow of pressurised abrasive slurry into a defined jet.

25. A method as claimed in claim 11, wherein the common outlet is one or more nozzles, each of which is for forming at least a portion of the uninterrupted flow of pressurised abrasive slurry into a defined jet.

26. A method as claimed in claim 12, wherein the common outlet is one or more nozzles, each of which is for forming at least a portion of the uninterrupted flow of pressurised abrasive slurry into a defined jet.

27. A method as claimed in claim 13, wherein the common outlet is one or more nozzles, each of which is for forming at least a portion of the uninterrupted flow of pressurised abrasive slurry into a defined jet.

28. A method as claimed in claim 14, wherein the common outlet is one or more nozzles, each of which is for forming at least a portion of the uninterrupted flow of pressurised abrasive slurry into a defined jet.

29. A method as claimed in claim 1, wherein the number of vessels is two, abrasive slurry is discharged from a first of the two vessels while the second vessel is charged with the abrasive material, and abrasive slurry is discharged from the second vessel while the first vessel is charged with the abrasive material.

30. A method as claimed in claim 2, wherein the number of vessels is two, abrasive slurry is discharged from a first of the two vessels while the second vessel is charged with the abrasive material, and abrasive slurry is discharged from the second vessel while the first vessel is charged with the abrasive material.

31. A method as claimed in claim 3, wherein the number of vessels is two, abrasive slurry is discharged from a first of the two vessels while the second vessel is charged with the abrasive material, and abrasive slurry is discharged from the second vessel while the first vessel is charged with the abrasive material.

32. A method as claimed in claim 4, wherein the number of vessels is two, abrasive slurry is discharged from a first of the two vessels while the second vessel is charged with the abrasive material, and abrasive slurry is discharged from the second vessel while the first vessel is charged with the abrasive material.

33. A method as claimed in claim 5, wherein the number of vessels is two, abrasive slurry is discharged from a first of the two vessels while the second vessel is charged with the abrasive material, and abrasive slurry is discharged from the second vessel while the first vessel is charged with the abrasive material.

34. A method as claimed in claim 6, wherein the number of vessels is two, abrasive slurry is discharged from a first of the two vessels while the second vessel is charged with the abrasive material, and abrasive slurry is discharged from the second vessel while the first vessel is charged with the abrasive material.

35. A method as claimed in claim 7, wherein the number of vessels is two, abrasive slurry is discharged from a first of the two vessels while the second vessel is charged with the abrasive material, and abrasive slurry is discharged from the second vessel while the first vessel is charged with the abrasive material.

36. A method as claimed in claim 8, wherein the number of vessels is two, abrasive slurry is discharged from a first of the two vessels while the second vessel is charged with the abrasive material, and abrasive slurry is discharged from the second vessel while the first vessel is charged with the abrasive material.

37. A method as claimed in claim 9, wherein the number of vessels is two, abrasive slurry is discharged from a first of the two vessels while the second vessel is charged with the abrasive material, and abrasive slurry is discharged from the second vessel while the first vessel is charged with the abrasive material.

38. A method as claimed in claim 10, wherein the number of vessels is two, abrasive slurry is discharged from a first of the two vessels while the second vessel is charged with the abrasive material, and abrasive slurry is discharged from the second vessel while the first vessel is charged with the abrasive material.

39. A method as claimed in claim 11, wherein the number of vessels is two, abrasive slurry is discharged from a first of the two vessels while the second vessel is charged with the abrasive material, and abrasive slurry is discharged from the second vessel while the first vessel is charged with the abrasive material.

40. A method as claimed in claim 12, wherein the number of vessels is two, abrasive slurry is discharged from a first of the two vessels while the second vessel is charged with the abrasive material, and abrasive slurry is discharged from the second vessel while the first vessel is charged with the abrasive material.

41. A method as claimed in claim 13, wherein the number of vessels is two, abrasive slurry is discharged from a first of the two vessels while the second vessel is charged with the abrasive material, and abrasive slurry is discharged from the second vessel while the first vessel is charged with the abrasive material.

42. A method as claimed in claim 14, wherein the number of vessels is two, abrasive slurry is discharged from a first of the two vessels while the second vessel is charged with the abrasive material, and abrasive slurry is discharged from the second vessel while the first vessel is charged with the abrasive material.

43. A method as claimed in claim 15, wherein the number of vessels is two, abrasive slurry is discharged from a first of the two vessels while the second vessel is charged with the abrasive material, and abrasive slurry is discharged from the second vessel while the first vessel is charged with the abrasive material.

44. A method as claimed in claim 16, wherein the number of vessels is two, abrasive slurry is discharged from a first of the two vessels while the second vessel is charged with the abrasive material, and abrasive slurry is discharged from the second vessel while the first vessel is charged with the abrasive material.

45. A method as claimed in claim 17, wherein the number of vessels is two, abrasive slurry is discharged from a first of the two vessels while the second vessel is charged with the abrasive material, and abrasive slurry is discharged from the second vessel while the first vessel is charged with the abrasive material.

46. A method as claimed in claim 18, wherein the number of vessels is two, abrasive slurry is discharged from a first of the two vessels while the second vessel is charged with the abrasive material, and abrasive slurry is discharged from the second vessel while the first vessel is charged with the abrasive material.

47. A method as claimed in claim 19, wherein the number of vessels is two, abrasive slurry is discharged from a first of the two vessels while the second vessel is charged with the abrasive material, and abrasive slurry is discharged from the second vessel while the first vessel is charged with the abrasive material.

48. A method as claimed in claim 20, wherein the number of vessels is two, abrasive slurry is discharged from a first of the two vessels while the second vessel is charged with the abrasive material, and abrasive slurry is discharged from the second vessel while the first vessel is charged with the abrasive material.

49. A method as claimed in claim 21, wherein the number of vessels is two, abrasive slurry is discharged from a first of the two vessels while the second vessel is charged with the abrasive material, and abrasive slurry is discharged from the second vessel while the first vessel is charged with the abrasive material.

50. A method as claimed in claim 22, wherein the number of vessels is two, abrasive slurry is discharged from a first of the two vessels while the second vessel is charged with the abrasive material, and abrasive slurry is discharged from the second vessel while the first vessel is charged with the abrasive material.

51. A method as claimed in claim 23, wherein the number of vessels is two, abrasive slurry is discharged from a first of the two vessels while the second vessel is charged with the abrasive material, and abrasive slurry is discharged from the second vessel while the first vessel is charged with the abrasive material.

52. A method as claimed in claim 24, wherein the number of vessels is two, abrasive slurry is discharged from a first of the two vessels while the second vessel is charged with the abrasive material, and abrasive slurry is discharged from the second vessel while the first vessel is charged with the abrasive material.

53. A method as claimed in claim 25, wherein the number of vessels is two, abrasive slurry is discharged from a first of the two vessels while the second vessel is charged with the abrasive material, and abrasive slurry is discharged from the second vessel while the first vessel is charged with the abrasive material.

54. A method as claimed in claim 26, wherein the number of vessels is two, abrasive slurry is discharged from a first of the two vessels while the second vessel is charged with the abrasive material, and abrasive slurry is discharged from the second vessel while the first vessel is charged with the abrasive material.

55. A method as claimed in claim 27, wherein the number of vessels is two, abrasive slurry is discharged from a first of the two vessels while the second vessel is charged with the abrasive material, and abrasive slurry is discharged from the second vessel while the first vessel is charged with the abrasive material.

56. A method as claimed in claim 28, wherein the number of vessels is two, abrasive slurry is discharged from a first of the two vessels while the second vessel is charged with the abrasive material, and abrasive slurry is discharged from the second vessel while the first vessel is charged with the abrasive material.

* * * * *